US012644610B2

(12) United States Patent
Lee et al.

(10) Patent No.: US 12,644,610 B2
(45) Date of Patent: Jun. 2, 2026

(54) VENTILATION HOOD

(71) Applicant: SAMSUNG ELECTRONICS CO., LTD., Suwon-si (KR)

(72) Inventors: Sangjin Lee, Suwon-si (KR); Myoungkeun Kwon, Suwon-si (KR); Sangjin Kim, Suwon-si (KR); Eungryeol Seo, Suwon-si (KR); Changhoon Oh, Suwon-si (KR); Qasim Khan, Suwon-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 668 days.

(21) Appl. No.: 17/968,990

(22) Filed: Oct. 19, 2022

(65) Prior Publication Data

US 2023/0124866 A1 Apr. 20, 2023

Related U.S. Application Data

(63) Continuation of application No. PCT/KR2022/014097, filed on Sep. 21, 2022.

(30) Foreign Application Priority Data

Oct. 15, 2021 (KR) ..... 10-2021-0137497
Nov. 25, 2021 (KR) ..... 10-2021-0164075

(51) Int. Cl.
*F24C 15/20* (2006.01)

(52) U.S. Cl.
CPC ..... *F24C 15/2042* (2013.01); *F24C 15/2021* (2013.01)

(58) Field of Classification Search
CPC ..... F24C 15/2042; F24C 15/2021; F24C 15/2064; F24C 15/2092; F24F 7/06; F24F 13/20

(Continued)

(56) References Cited

U.S. PATENT DOCUMENTS 3,098,423 A * 7/1963 Giannini ..... F24C 15/2071 126/299 D
5,983,888 A 11/1999 Anselmino et al.
(Continued)

FOREIGN PATENT DOCUMENTS

CN 2306425 Y 2/1999
CN 104421992 A 3/2015
(Continued)

OTHER PUBLICATIONS

Chinese to English machine translation of CN_106871202_A.*
(Continued)

*Primary Examiner* — Michael G Hoang
*Assistant Examiner* — Elizabeth Ann Laughlin
(74) *Attorney, Agent, or Firm* — CANTOR COLBURN LLP

(57) ABSTRACT

A ventilation hood includes a main frame which faces an appliance accessible from a front of the appliance, the main frame defining a through-hole passing through the main frame, a motor module on the main frame and configured to suck in air through the through-hole, the motor module including a duct, a motor having an axis, and an exhaust fan driven by the motor and defining a blowing direction perpendicular to the axis of the motor, and a controller configured to control operation of the ventilation hood and a rotation velocity of the exhaust fan. The axis of the motor is in a direction from the front of the appliance to a rear of the appliance which is opposite to the front. The controller is on the main frame and at a front of the duct which corresponds to the front of the appliance.

20 Claims, 23 Drawing Sheets

(58) Field of Classification Search
USPC ..... 126/229 R
See application file for complete search history.

(56) References Cited

U.S. PATENT DOCUMENTS

| | | | | |
|---|---|---|---|---|
| 10,378,777 | B2 | 8/2019 | Sinur et al. | |
| 10,493,506 | B2 * | 12/2019 | Kim | F24F 7/065 |
| 2006/0231553 | A1 * | 10/2006 | Gerami | B08B 15/02 219/757 |
| 2021/0172624 | A1 * | 6/2021 | Kim | F24F 1/0073 |

FOREIGN PATENT DOCUMENTS

| | | | | |
|---|---|---|---|---|
| CN | 106287889 | A | 1/2017 | |
| CN | 106871202 | A * | 6/2017 | F24C 15/2021 |
| CN | 111237834 | A | 6/2020 | |
| CN | 111396942 | A | 7/2020 | |
| CN | 110500626 | A | 5/2021 | |
| CN | 113154480 | A | 7/2021 | |
| DE | 102015104631 | A1 | 9/2016 | |
| EP | 2937634 | B1 | 2/2019 | |
| JP | 2013168231 | A | 8/2013 | |
| JP | 2021139369 | A | 9/2021 | |
| KR | 20050032995 | A | 4/2005 | |
| KR | 100669090 | B1 * | 1/2007 | F24F 7/007 |
| KR | 100677289 | B1 | 2/2007 | |
| KR | 1020180081343 | A | 7/2018 | |
| KR | 1020200065826 | A | 6/2020 | |
| KR | 1020200119470 | A | 10/2020 | |
| WO | WO-2021128961 | A1 * | 7/2021 | F24C 15/2042 |

OTHER PUBLICATIONS

Korean to English machine translation of KR_100669090_B1.*
Chinese to English machine translation of WO2021128961A1.*
European Patent Office on Nov. 26, 2024 for the corresponding EP Patent Application No. 22881235.0.

* cited by examiner

VENTILATION HOOD

CROSS-REFERENCE TO RELATED APPLICATIONS

This application is a PCT-Bypass Continuation application of International Application No. PCT/KR2022/014097 designating the United States, filed on Sep. 21, 2022, at the Korean Intellectual Property Receiving Office and claiming priority to Korean Patent Application No. 10-2021-0137497, filed on Oct. 15, 2021 and Korean Patent Application No. 10-2021-0164075, filed on Nov. 25, 2021, at the Korean Intellectual Property Office, and all the benefits accruing therefrom under 35 U.S.C. § 119, the disclosures of which are incorporated by reference herein in their entireties.

BACKGROUND

1. Field

The following various example embodiments relate to a hood.

2. Description of Related Art

In general, a hood is a device installed on an upper portion of a cook top in the kitchen to prevent the spread of polluted air, smoke, and odors generated during cooking by sucking air from the bottom of the hood. Such hood may be any of various types of hoods, such as a sliding-type hood, a tube-type hood, a chimney-type hood, an island-type hood, a canopy-type hood, and the like.

SUMMARY

Example embodiments of the disclosure may provide a hood that provides ventilation and includes various functional modules of which the arrangement may be adjusted such that a space in which the hood is disposed may be efficiently utilized.

Example embodiments of the disclosure may provide a hood that provides ventilation and includes an expansion module which provides a function to the hood and is removably combinable with a main frame module in the main frame of the hood such that the hood may be customizable into a form desired by a consumer of the hood.

Example embodiments of the disclosure may provide a hood that includes an expansion module including various functional units removably combinable with a main frame module in the main frame of the hood, whereby a suction effect of the hood is improved.

According to various example embodiments, a hood includes a main frame module including a first surface and a second surface formed on an opposite side of the first surface, and a through-hole passing through the first surface and the second surface, a motor module including a duct, a motor, and an exhaust fan driven by the motor, the blowing direction of the exhaust fan being perpendicular to an axis of the motor, the motor module being disposed on the first surface of the main frame module, facing the second surface of the main frame module and configured to suck in air through the through-hole of the main frame module, and a control module configured to control whether the hood operates and to control a rotation velocity of the exhaust fan included in the motor module of the hood. The axis of the motor of the motor module may be disposed in a direction from a front surface to a rear surface of the hood, and the control module may be disposed on the first surface of the main frame module.

According to various example embodiments, a hood includes a main frame module including a first surface and a second surface formed on an opposite side of the first surface, and a through-hole passing through the first surface and the second surface, a motor module including a duct, a motor, and an exhaust fan driven by the motor, the blowing direction of the exhaust fan being perpendicular to an axis of the motor, the motor module being disposed on the first surface of the main frame module, facing the second surface of the main frame module and configured to suck in air through the through-hole of the main frame module, and a control module configured to control whether the hood operates and to control a rotation velocity of the exhaust fan included in the motor module of the hood. A third surface disposed on an outer lateral portion of the first surface of the main frame module may include a bracket having a first assembly structure.

According to various example embodiments, a hood includes a main frame module including a first surface and a second surface formed on an opposite side of the first surface, and a through-hole passing through the first surface and the second surface, a motor module including a duct, a motor, and an exhaust fan driven by the motor, the blowing direction of the exhaust fan being perpendicular to an axis of the motor, the motor module being disposed on the first surface of the main frame module, facing the second surface of the main frame module and configured to suck in air through the through-hole of the main frame module, a control module configured to control whether the hood operates and to control a rotation velocity of the exhaust fan included in the motor module of the hood, and one or more expansion module coupled in a direction parallel to the first surface of the main frame module. The expansion module may be connected to the main frame module or connected to another expansion module.

According to various example embodiments, a hood may include functional modules (f which the arrangement may be adjusted such that a space in which the hood is disposed may be efficiently utilized.

According to various example embodiments, a hood may include an expansion module which provides a function to the hood and is removably combinable with a main frame module in the main frame of the hood such that the hood may be customized in a form desired by a consumer.

According to various example embodiments, a hood may include an expansion module including various functional units combined with a main frame module in the main frame of the hood whereby a suction effect of the hood is improved.

The effects of the hood are not limited to the above-mentioned effects, and other unmentioned effects can be clearly understood from the above description by those having ordinary skill in the technical field to which the present disclosure pertains.

BRIEF DESCRIPTION OF THE DRAWINGS

The above and other aspects, features, and advantages of embodiments of the present disclosure will be more apparent from the following detailed description, taken in conjunction with the accompanying drawings, in which.

DETAILED DESCRIPTION

Figure 1:
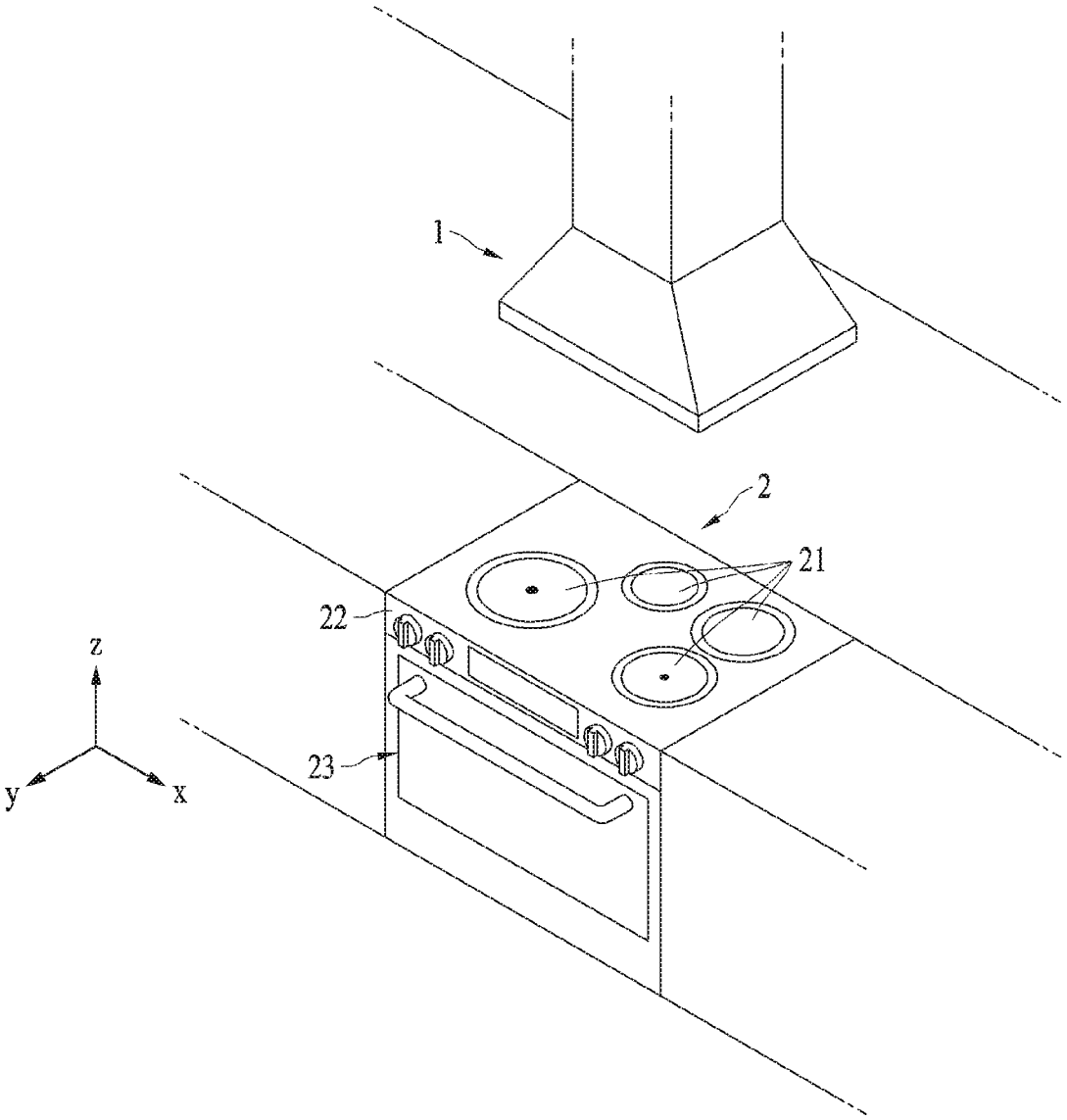
FIG. 1 is a view of a hood and kitchen appliances according to an example embodiment.

Hereinafter, examples will be described in detail with reference to the accompanying drawings. However, various alterations and modifications may be made to the example embodiments. Here, the example embodiments are not to be construed as limited to the disclosure. The example embodiments should be understood to include all changes, equivalents, and replacements within the idea and the technical scope of the disclosure.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. The terminology used herein is for the purpose of describing particular example embodiments only and is not to be limiting of the example embodiments. The singular forms "a", "an", and "the" are intended to include the plural forms as well, unless the context clearly indicates otherwise.

It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms including technical and scientific terms used herein have the same meaning as commonly understood by one of ordinary skill in the art to which examples belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

When describing the examples with reference to the accompanying drawings, like reference numerals refer to like constituent elements and any repeated description related thereto will be omitted. In the description of the example embodiments, a detailed description of well-known related structures or functions will be omitted when it is deemed that such description will cause ambiguous interpretation of the present disclosure. As used herein, a reference number may indicate a singular element or a plurality of the element. For example, a reference number labeling a singular form of an element within the drawing figures may be used to reference a plurality of the singular element within the text of specification.

Also, in the description of the components, terms such as first, second, A, B, (a), (b) or the like may be used herein when describing components of the present disclosure. These terms are used only for the purpose of discriminating one constituent element from another constituent element, and the nature, the sequences, or the orders of the constituent elements are not limited by the terms.

When one constituent element is described as being "connected", "coupled", or "attached" to another constituent element, it should be understood that one constituent element can be connected or attached directly to another constituent element, or an intervening constituent element can also be "connected", "coupled", or "attached" to the constituent elements. In contrast, when one constituent element is described as being "directly connected", "directly coupled", or "directly attached" to another constituent element, it should be understood that no intervening constituent element is therebetween.

A constituent element, which has the same common function as a constituent element included in any one example embodiment, will be described by using the same name in other example embodiments. Unless disclosed to the contrary, the configuration disclosed in any one example embodiment may be applied to other example embodiments, and a specific description of the repeated configuration will be omitted.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

'Upper side' and 'lower side' used herein may refer to a vertical direction of a hood 1 or an appliance such as a cooking appliance 2 according to an example embodiment illustrated in FIG. 1. The appliance may generate a pollutant or may be a device from which air, pollutants, odors, etc. is moved away. That is, the top of the hood 1 or the cooking appliance 2 is described as the upper side in FIG. 1, and the bottom of the hood 1 or the cooking appliance 2 is described as the lower side in FIG. 1.

With respect to 'front surface', 'front', 'rear surface', and 'rear' used herein, an open side on which a door part 23 of the cooking appliance 2 is disposed as illustrated in FIG. 1, is described as a 'front surface' or a 'front' in FIG. 1 and a closed side opposite to the open side is described as a 'rear surface' or a 'rear' in FIG. 1. The 'front' of the cooking appliance 2 may be in the +y direction, while the 'rear' may be in the −y direction. The 'front' and the 'rear' of the hood 1 may correspond to those of the appliance which the hood 1 faces (e.g., the cooking appliance 2). That is, various components of the hood 1 and/or the appliance may have a 'front' and a 'rear' corresponding to those described above for the hood 1 and the appliance.

FIG. 1 is a view of a hood 1 and kitchen appliances according to an example embodiment.

Referring to FIG. 1, the hood 1 may be disposed to be spaced apart from an upper side (e.g., a+z direction side in FIG. 1) of a cooktop-type cooking appliance 2, such as a gas range or induction range. In addition to a form shown in FIG. 1, the hood 1 may include various forms of hood such as a sliding-type hood, a tube-type hood, a chimney-type hood, an island-type hood, a canopy-type hood, and the like. The hood 1 may be installed to be secured on a wall of a building or a ceiling of the building. The hood 1 as a ventilation hood may be disposed on the upper side (e.g., the +z direction side in FIG. 1) of the cooking appliance 2 to suck in pollutants such as polluted air, smoke, and odors generated from the cooking appliance 2 and discharge the pollutants to the outside. That is, the hood 1 moves the pollutants away from the cooking appliance 2.

The hood 1 may include a housing that forms the exterior of the hood 1 and accommodates each component, an exhaust fan that absorbs polluted air, smoke, and odors generated while cooking food in the cooking appliance 2, and forms a flow of air, and a flow path formed by various ducts.

The cooking appliance 2 may include a heating part 21 to heat food, a heating body 22, and a door part 23.

Figure 2:
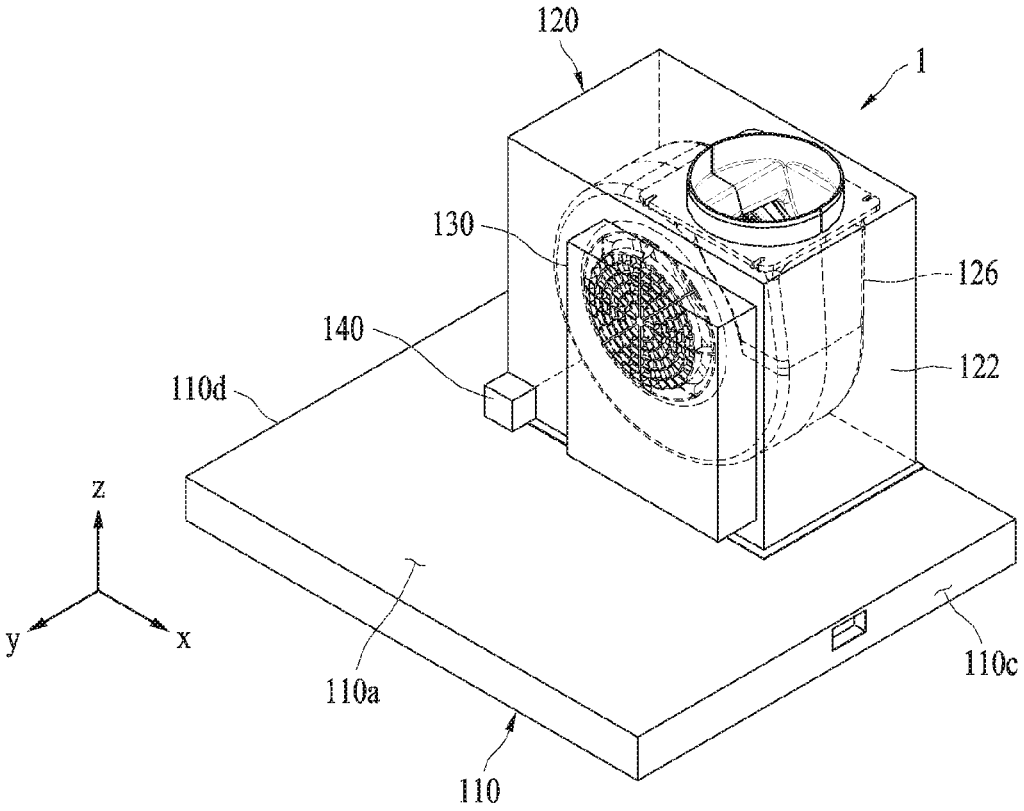
FIG. 2 is a perspective view of a hood according to an example embodiment.

FIG. 2 is a perspective view of a hood 1 according to an example embodiment.

Referring to FIG. 2, the hood 1 may include a main frame module 110, a motor module 120, and a control module 130 (e.g., controller). The main frame module 110 may determine an area range (e.g., a planar area) from which air is sucked into the hood 1, and the greater an area of the main frame module 110 is, the wider the range of air that may be sucked in. The motor module 120 may include a duct 122, a motor 124, and an exhaust fan 126. Air at the upper side (e.g., the +z direction side in FIG. 1) of the cooking appliance 2 may be sucked into the duct 122 through the main frame module 110, by the exhaust fan 126 driven by the motor 124, and the air may be discharged to the outside (e.g., outside of the hood 1) through an exhaust port of the exhaust fan 126.

The control module 130 may control whether or not the hood 1 operates and a rotation velocity of the exhaust fan 126 included in the motor module 120 of the hood 1. That is, the controller may be in communication with various components of the hood 1 such as the motor module 120, the exhaust fan 126, the dust sensor, the curtain of the side-wall module 150, etc.

Figure 3A:
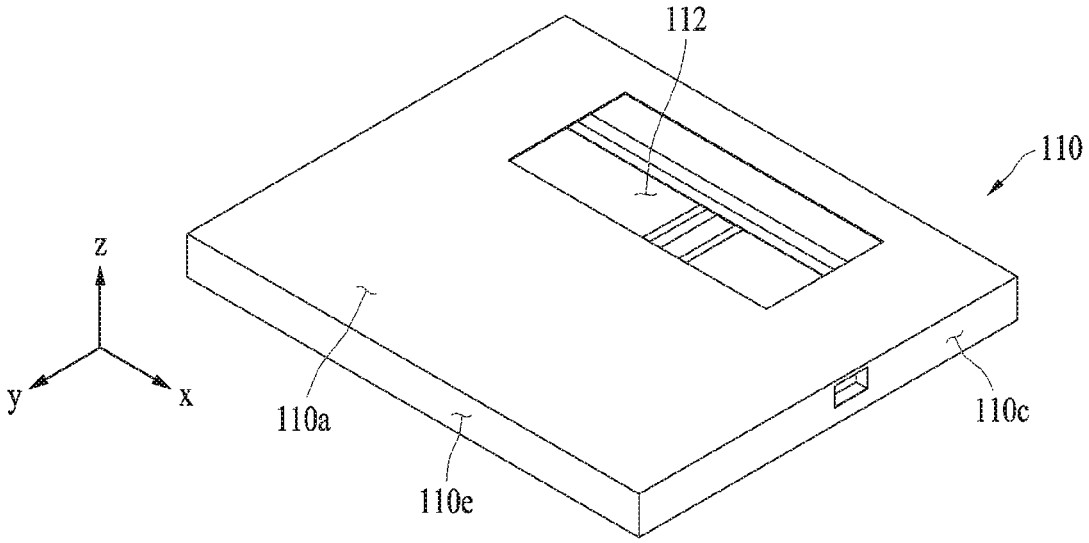
FIG. 3A is a top perspective view of a main frame module of a hood according to an example embodiment.
Figure 3B:
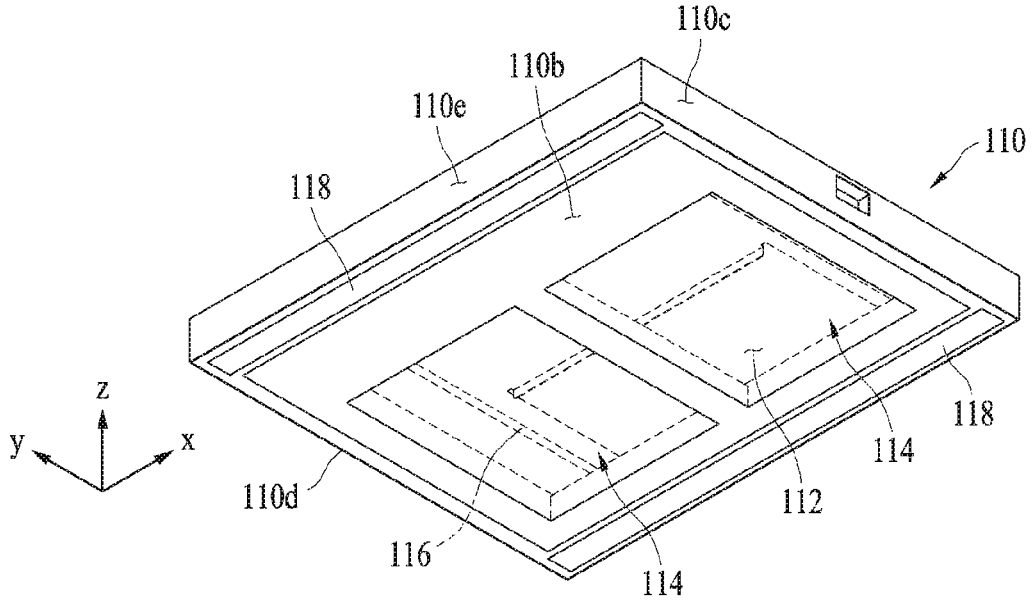
FIG. 3B is a bottom perspective view of a main frame module of a hood according to an example embodiment.

FIGS. 3A and 3B are a top perspective view and a bottom perspective view of a main frame module of a hood according to an example embodiment.

Referring to FIGS. 3A and 3B, the main frame module 110 may include a first surface 110*a* (e.g., a surface facing a+z direction in FIG. 3A) closest to the ceiling when the hood is disposed to be spaced apart from the upper side (e.g., the +z direction side in FIG. 1) of the cooking appliance 2, and a second surface 110*b* (e.g., a surface facing a −z direction in FIG. 3A) formed on the opposite side of the first surface 110*a* so that it is closest to the floor when the hood is disposed to be spaced apart from the upper side (e.g., the +z direction side in FIG. 1) of the cooking appliance 2. The first surface 110*a* and the second surface 110*b* may be defined by a surface of a first (upper) portion of the frame and a surface of a second (lower) portion of the main frame (e.g., main frame module 110), where the first and second portions face each other along the z direction. In addition, the hood may include a third surface 110*c* (e.g., a surface facing a +x direction in FIG. 3A) disposed on an outer lateral portion of the first surface 110*a* and corresponding to a right surface of the main frame module 110 in FIG. 1, a fourth surface 110*d* (e.g., a surface facing a −x direction in FIG. 3A) disposed on the outer lateral portion of the first surface 110*a* and corresponding to a left surface of the main frame module 110 in FIG. 1, a fifth surface 110*e* (e.g., a surface facing a +y direction in FIG. 3A) disposed on the outer lateral portion of the first surface 110*a* and corresponding to a front surface of the main frame module 110 in FIG. 1, and a sixth surface (e.g., a surface facing a −y direction in FIG. 3A) disposed on the outer lateral portion of the first surface 110*a* and corresponding to a rear surface of the main frame module 110 in FIG. 1. The third to sixth surfaces may together define a side surface of the main frame module 110 and connect the first and second surfaces thereof to each other.

Referring again to FIG. 3B, the main frame module 110 may include a through-hole 112 passing through a thickness of the main frame module 110 and open at both the first surface 110*a* and the second surface 110*b*, a filter 114 disposed on (or at) the second surface 110*b* and that filters out large-sized particles when air is being sucked from the upper side (e.g., the +z direction side in FIG. 1) of the cooking appliance 2, one or more bracket frame 116 disposed on (or at) the second surface 110*b* and protruding perpendicular to the second surface 110*b*, and a lamp unit 118 disposed in a front and rear of the through-hole 112 of the second surface 110*b*. Referring to FIG. 3B, the filter 114 may form an outer surface of the main frame at the second surface 110*b*. The bracket 116 (shown in dotted lines) may be internal to the filter 114.

According to an example embodiment, the bracket frame 116 may compartmentalize one area of the second surface 110*b* including the through-hole 112 of the main frame module 110 and another area of the second surface 110*b* not including the through-hole 112.

For example, the bracket frame 116 may be disposed to cross the second surface 110*b* of the main frame module 110 in the x direction and to protrude in the −z direction of the second surface 110*b* in FIG. 3B.

For example, the one area of the second surface 110*b* may be an area between the two bracket frames 116 in FIG. 3B, and the other area of the second surface 110*b* may be an area between the third surface 110*c* and the bracket frame 116 closest to the third surface 110*c* of the main frame module 110, or an area between the fourth surface 110*d* and the bracket frame 116 closest to the fourth surface 110*d* of the main frame module 110.

According to an example embodiment, by compartmentalizing the second surface 110*b* of the main frame module 110 using the bracket frame 116, an effective suction area through which air flows into the hood 1 while the hood 1 is operating may be reduced, thereby improving suction performance since a relatively low pressure may be formed at a lower end of the filter 114 of the main frame module 110. In addition, since the bracket frame 116 may be disposed to extend in a front-rear direction of the main frame module 110 (see FIG. 3B), the rigidity and durability of the main frame module 110 may be increased.

Referring again to FIG. 3B, the main frame module 110 may further include a lamp unit 118. The lamp unit 118 may be disposed in each of the front and rear of the through-hole 112 of the main frame module 110, respectively. The lamp unit 118 may illuminate the heating part 21 or a peripheral portion of the heating part 21 when food is being cooked on the cooking appliance 2 to increase user convenience.

Hereinafter, the motor module 120 according to an example embodiment is described in detail.

Figure 4:
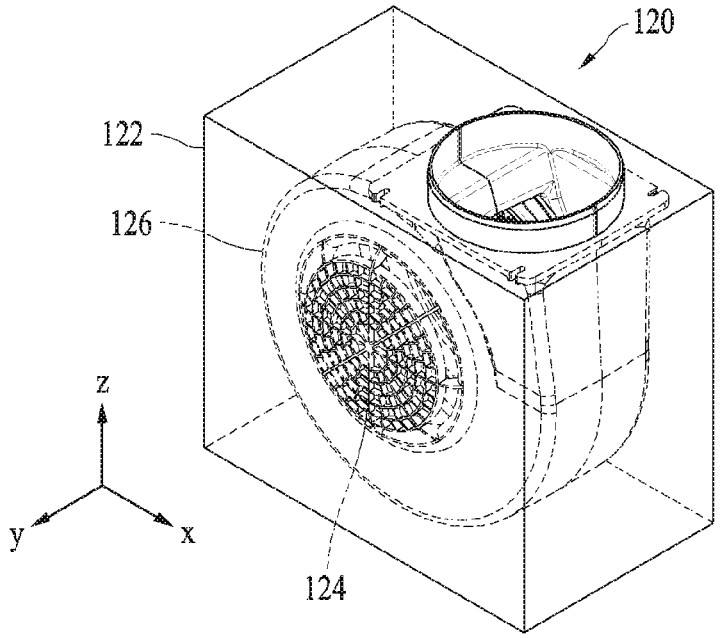
FIG. 4 is a plan perspective view of a motor module of a hood according to an example embodiment.

FIG. 4 is a plan perspective view of the motor module 120 of the hood 1 according to an example embodiment.

Referring to FIG. 4, the motor module 120 may include the duct 122, the motor 124, and the exhaust fan 126. The duct 122 may be disposed to enclose internal components of the motor module 120, and as illustrated in FIG. 4, the duct 122 may have a cuboid shape. The duct 122 may serve to prevent the air sucked into the hood 1 from escaping to the outside at the motor module 120, and the motor 124 may serve to drive the exhaust fan 126. In such case, the motor module 120 may be disposed on the first surface 110*a* of the main frame module 110 (see FIG. 2), facing the second surface 110*b* and may suck in air through the through-hole 112 of the main frame module 110. The duct 122 may correspond to the through-hole 112 in size, location, etc. without being limited thereto.

Figure 5A:
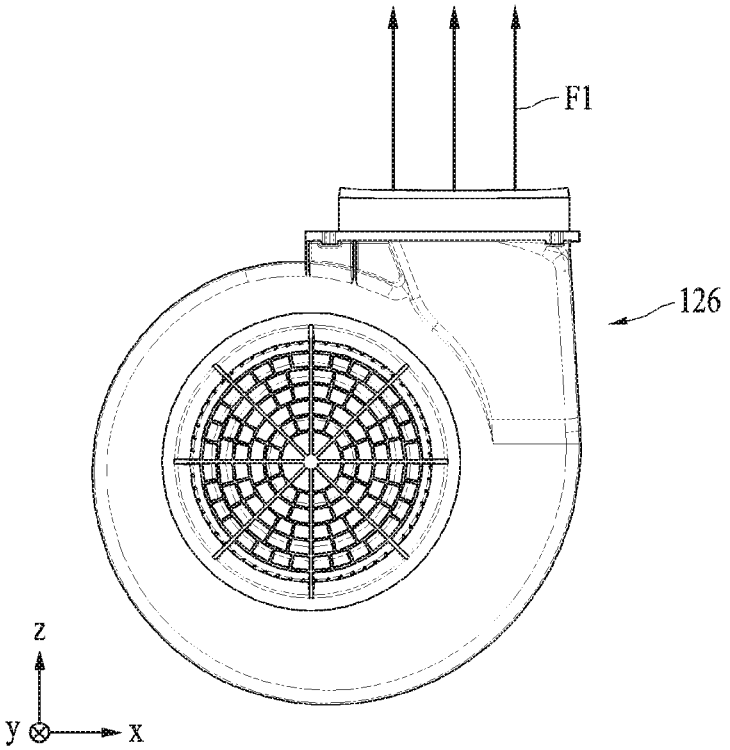
FIG. 5A is a front view of an exhaust fan in a motor module of a hood according to an example embodiment.
Figure 5B:
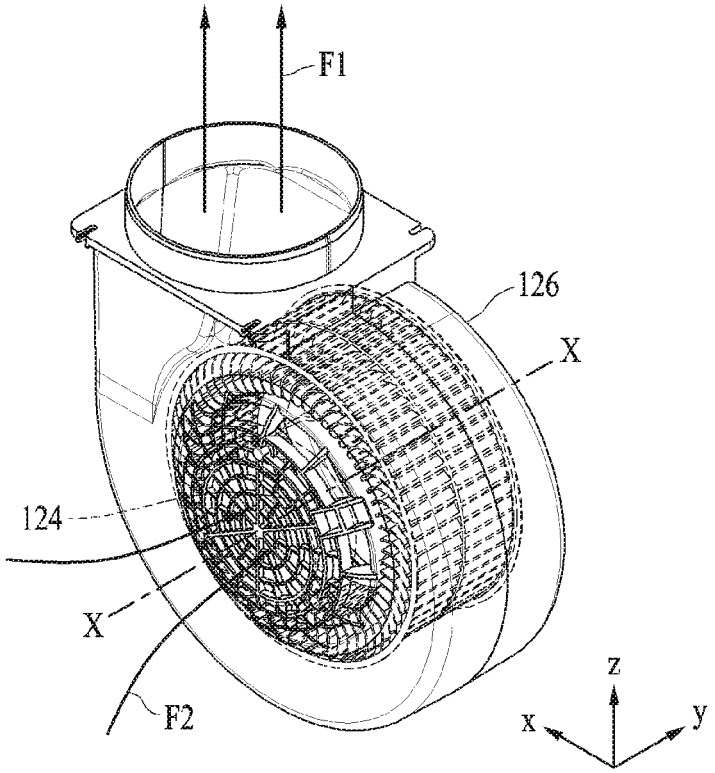
FIG. 5B is a perspective view of an exhaust fan in a motor module of a hood according to an example embodiment.
Figure 5C:
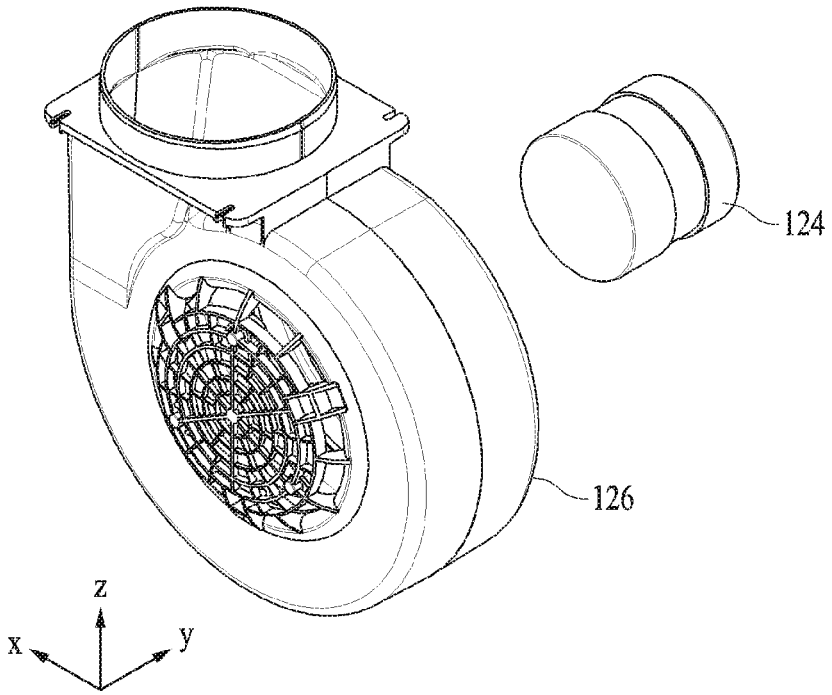
FIG. 5C is an exploded perspective view of an exhaust fan in a motor module of a hood according to an example embodiment.

FIGS. 5A to 5C are a front view, a perspective view, and an exploded perspective view of the exhaust fan 126 in the motor module 120 of the hood 1 according to an example embodiment.

Referring to FIG. 5A, according to an example embodiment, the exhaust fan 126 may be a fan with an air blowing function including a sirocco fan, a turbo fan, a propeller fan, or a cross flow fan that generates an airflow, and desirably, a sirocco fan. The sirocco fan is mainly used as a ventilation fan because it produces less noise. More specifically, referring to FIG. 5B, the air discharged to the outside of the motor module 120 may flow out in an air outflow direction F1, and the air sucked into the exhaust fan 126 may flow in, in an air inflow direction F2. That is, the exhaust fan 126 may suck in the air in the direction F2 parallel to an axial direction X-X of the motor 124 (e.g., an axis of rotation), and may exhaust the air in the direction F1 crossing such as perpendicular to the axial direction X-X of the motor 124. The air inflow direction F2 extend in a direction from the front of the appliance (at which the appliance is accessible) to a rear of the appliance opposite to the front. The axial direction X-X of the motor 124 may correspond to a minimal dimension of the motor, where the dimension taken parallel to the first surface 110*a* (such as along the plane defined by the x-axis direction and the y-axis direction crossing each other).

According to an example embodiment, the axial direction X-X of the motor 124 of the motor module 120 may be disposed extended in a direction from a front surface (e.g., a +y direction in FIG. 5B) to a rear surface (e.g., a −y direction in FIG. 5B) of the hood 1. In this example, compared to a case in which the axial direction X-X of the motor 124 is disposed in a left-right direction (e.g., an x-axis direction in FIG. 5B) of the hood 1, a space occupied by the motor module may be reduced in a front-rear direction (e.g., a y-axis direction in FIG. 5B). Thus, a space where the hood 1 is disposed may be better utilized, for example, in case the hood 1 is disposed in an upper cabinet of the cooking appliance 2 and the upper cabinet has a limited width. Accordingly, the control module 130 may be disposed on the first surface 110*a* of the main frame module 110 and outside of the duct 122, thereby significantly reducing the possibility of contamination of the control module 130 by substances such as polluted air or oil vapor and improving serviceability of the hood 1 since even if an abnormality occurs in the control module 130, repair may be possible by simply opening only the upper cabinet. In addition, since the cooking appliance 2 is generally wider (e.g., in the x-axis direction) than the upper cabinet of the cooking appliance 2 accommodating the hood 1, suction performance may be improved when the exhaust fan 126 sucks in air in the front-rear direction of the hood 1 rather than in the left-right direction of the hood 1. A front direction may be a direction from which both the cooking appliance 2 and the hood 1 is accessible for repair, cleaning, etc.

Figure 6:
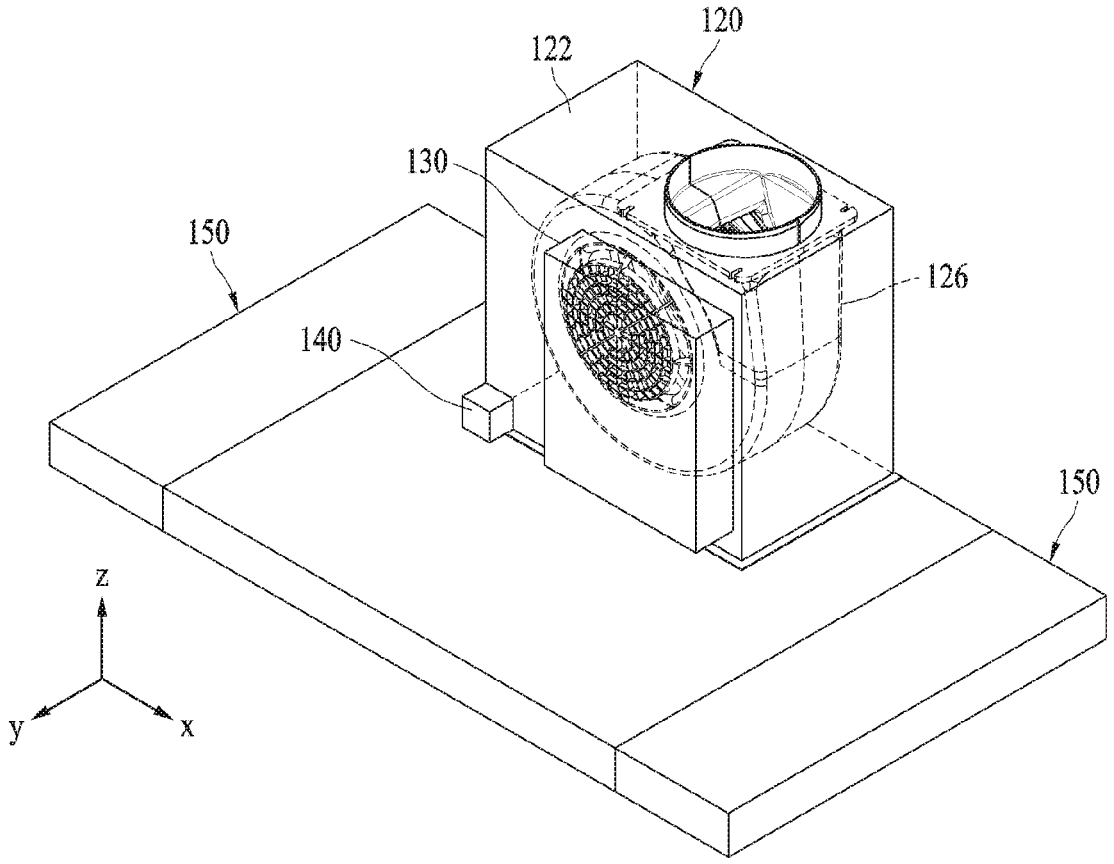
FIG. 6 is a perspective view of a hood according to an example embodiment.

FIG. 6 is a perspective view of the hood 1 to which a side-wall module 150 is coupled according to an example embodiment. The side-wall module 150 may extend from the main frame 110 or may be considered a portion of the main frame 110, without being limited thereto.

Referring to FIG. 6, the hood 1 may further include a fine dust sensor 140 disposed on the first surface 110*a* of the main frame module 110. The fine dust sensor 140 may measure a degree of pollution of the air, that is, an amount of fine dust, being sucked into the hood 1, and transmit to the control module 130 to determine whether or not to operate the hood 1 and to determine a rotation velocity of the exhaust fan 126 of the hood 1.

In general, fine dust is dust that has a very small particle size, and is mostly generated from burning fossil fuels such as coal and oil, or from exhaust gases from factories and automobiles.

In an example embodiment, the fine dust may be dust having a very small particle size included in polluted air, smoke, and the like generated in the process of cooking food in the cooking appliance 2.

The control module 130 may be set to turn on the power of the hood 1 when fine dust of a first concentration or higher is detected by the fine dust sensor 140, and to turn off the power of the hood 1 when fine dust of the first concentration or less is detected by the fine dust sensor 140. According to an example embodiment, the first concentration may be within about 0 to about 35 micrograms per cubic meter ($\mu g/m^3$ based) based on PM2.5 standard.

In addition, the control module 130 may increase the rotation velocity of the exhaust fan 126 included in the motor module 120 of the hood 1 when fine dust of a second concentration or higher is detected by the fine dust sensor 140, and reduce the rotation velocity of the exhaust fan 126 included in the motor module 120 of the hood 1 when fine dust of the second concentration or less is detected by the fine dust sensor 140. According to an example embodiment, the second concentration may be within about 35 to about 75 $\mu g/m^3$ based on PM 2.5 standard.

Figure 7:
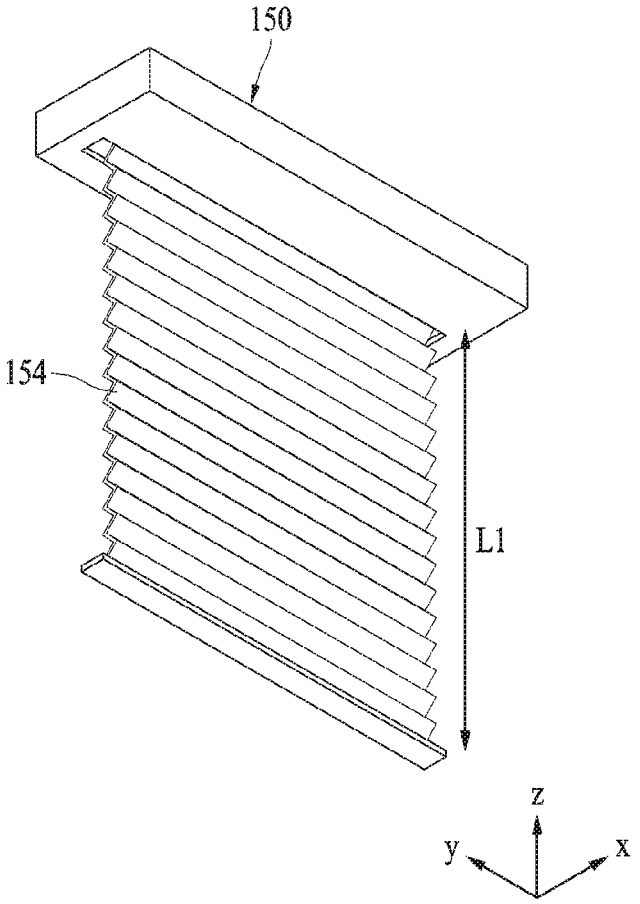
FIG. 7 is a bottom perspective view of a side-wall module according to an example embodiment.

FIG. 7 is a bottom perspective view of a side-wall module 150 according to an example embodiment.

According to an example embodiment, the hood 1 may further include the side-wall module 150. The side-wall module 150 may be disposed on an outer lateral portion of the first surface 110*a* and/or the second surface 110*b* of the main frame module 110, and may include a side-wall 154 or curtain which is extendable away from and retractable toward the hood 1. The curtain (e.g., the side-wall 154) may be extendable out of and retractable into the side-wall module 150, so as to be extendable out of and retractable into the hood 1. The side-wall 154 may be a member extending in a direction perpendicular to the second surface 110*b* of the main frame module 110 in the side-wall module 150. The side-wall 154 may serve as a physical barrier along the left-right direction to improve the suction performance of the hood 1. In addition, the side-wall 154 may prevent contaminants, polluted air, smoke, and odors generated during cooking in the heating part 21 of the cooking appliance 2 from escaping the cooking appliance 2. The contaminants according to an example embodiment may be oil, water droplets, or food waste generated from cooking.

Figure 8:
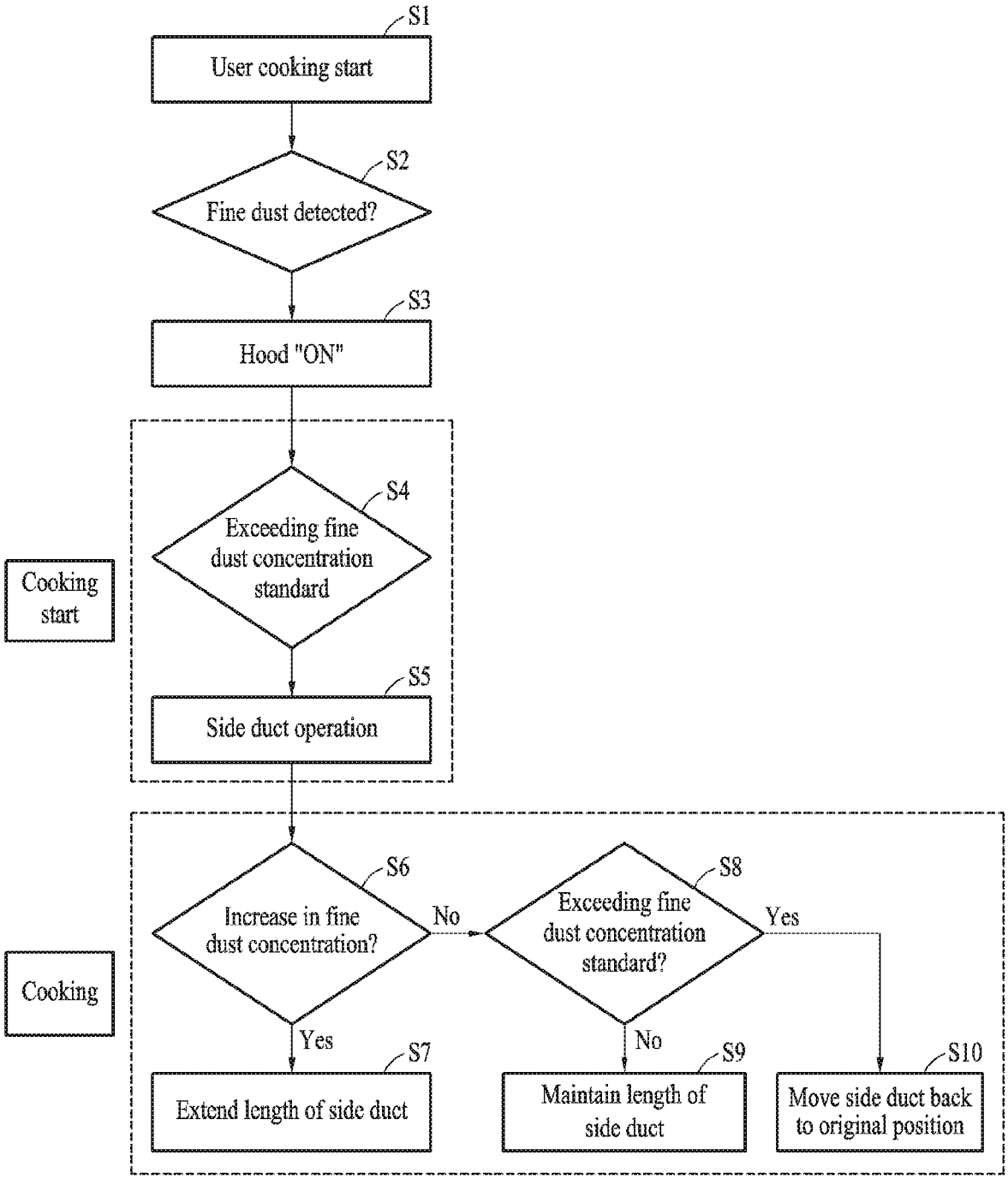
FIG. 8 is a flowchart illustrating an interlocking control algorithm of a fine dust sensor and a side-wall module according to an example embodiment.
Figure 9:
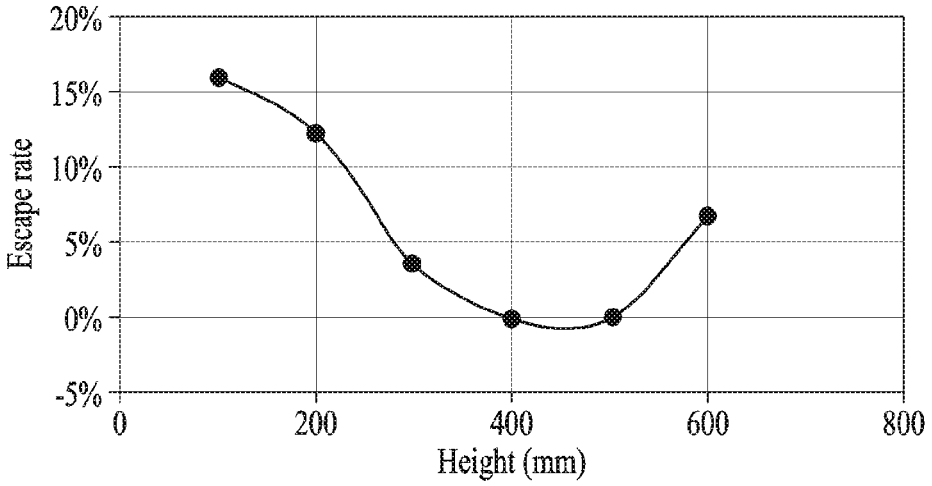
FIG. 9 is a graph illustrating an escape rate according to a first length of a side-wall according to an example embodiment.

FIG. 8 is a flowchart illustrating an interlocking control algorithm of the fine dust sensor 140 and the side-wall module 150 according to an example embodiment, and FIG. 9 is a graph illustrating an escape rate of pollutants according to a first length L1 of the side-wall 154 according to an example embodiment.

According to an example embodiment, when the fine dust sensor 140 of the hood 1 detects fine dust of the first concentration or higher, the power of the hood 1 may be turned on. When the concentration of the fine dust continues to increase even after the hood 1 is turned on, and the fine dust sensor 140 detects fine dust of a third concentration or higher, a length of the side-wall 154 of the side-wall module 150 may be extended toward the appliance and to the first length L1, and when the fine dust sensor 140 detects fine dust of the third concentration or less, the length of the side-wall 154 of the side-wall module 150 may be reduced to a second length L2. The first length L1 may be a length of the side-wall 154 extending in a direction perpendicular to the second surface 110*b* of the main frame module 110 in the side-wall module 150.

In such case, the first length L1 of the side-wall 154 may be about 350 mm or more, and desirably about 350 mm or more and about 450 mm or less. Referring to FIG. 9, when the first length L1 of the side-wall 154 is about 350 mm or more and about 450 mm or less, the escape rate may be the lowest. The escape rate may be a rate at which polluted air, smoke, or odor generated from food is not discharged to the outside through the hood 1 and leaks. That is, since the escape rate is the lowest in the above-mentioned length range, the suction performance of the hood 1 may be maximized when the side-wall 154 falls within the above-mentioned length range. The second length L2 of the side-wall 154 may be a length of the side-wall 154 in a state in which the side-wall module 150 is not operating, and the second length L2 may be about 50 mm or less, desirably, about 10 mm or less, and more desirably, about 0 mm.

According to an example embodiment, the side-wall 154 may return to an initial position when the power of the hood 1 is turned off, and the length of the side-wall 154 in the initial position may be the same as the second length L2 or shorter than the second length L2. An initial position may include a state in which the side-wall 154 is fully retracted into the main frame extension (e.g., the side-wall module 150) or is extended a minimum length.

Hereinafter, the hood 1 including a main frame module 210 (e.g., the main frame module 110) that includes an assembly structure, and an expansion module 250 that includes an assembly structure corresponding to the assembly structure of the main frame module 210 (e.g., the main frame module 110) is described in detail.

Figure 10A:
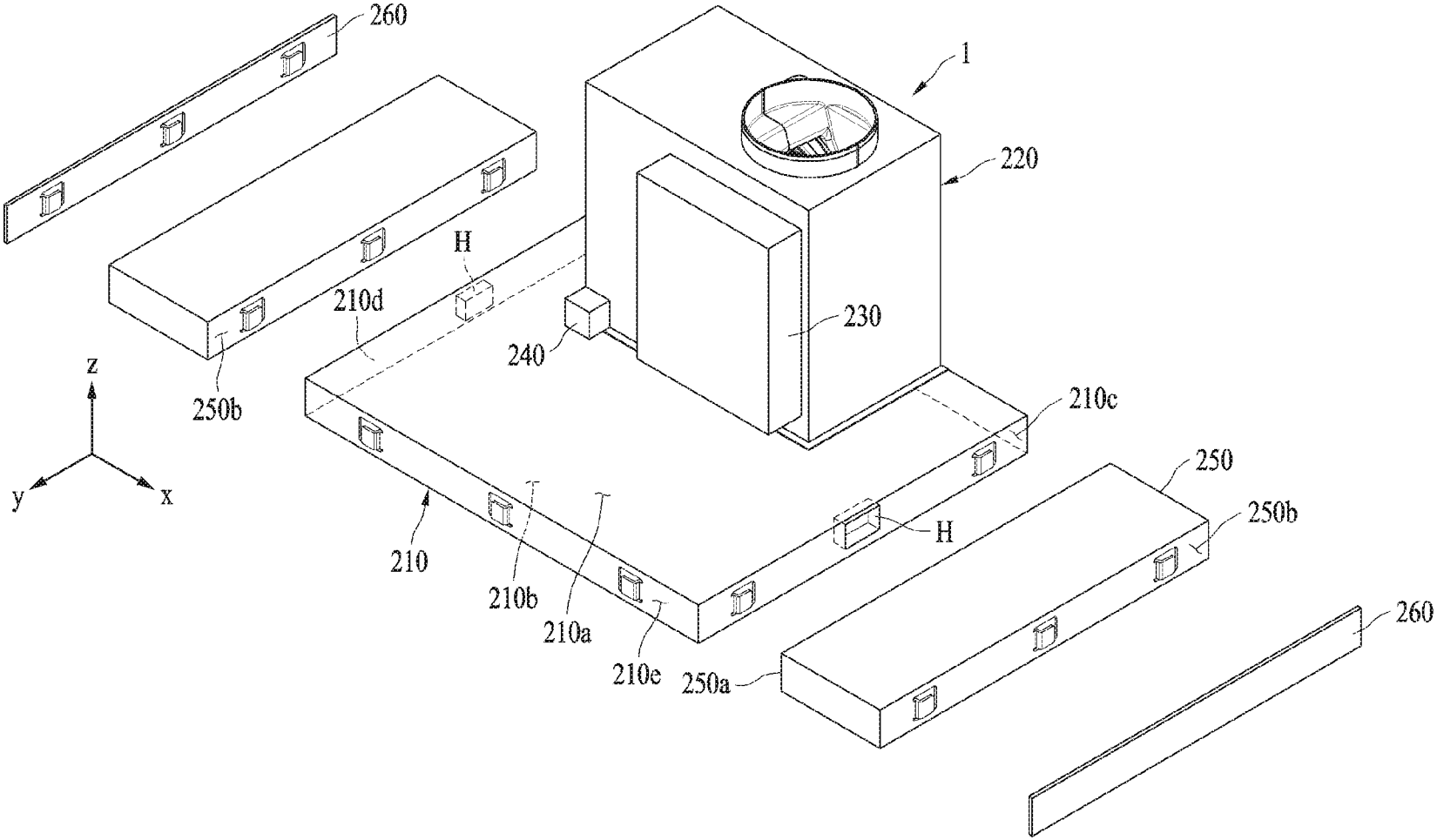
FIG. 10A is an exploded perspective view of a hood according to an example embodiment.
Figure 10B:
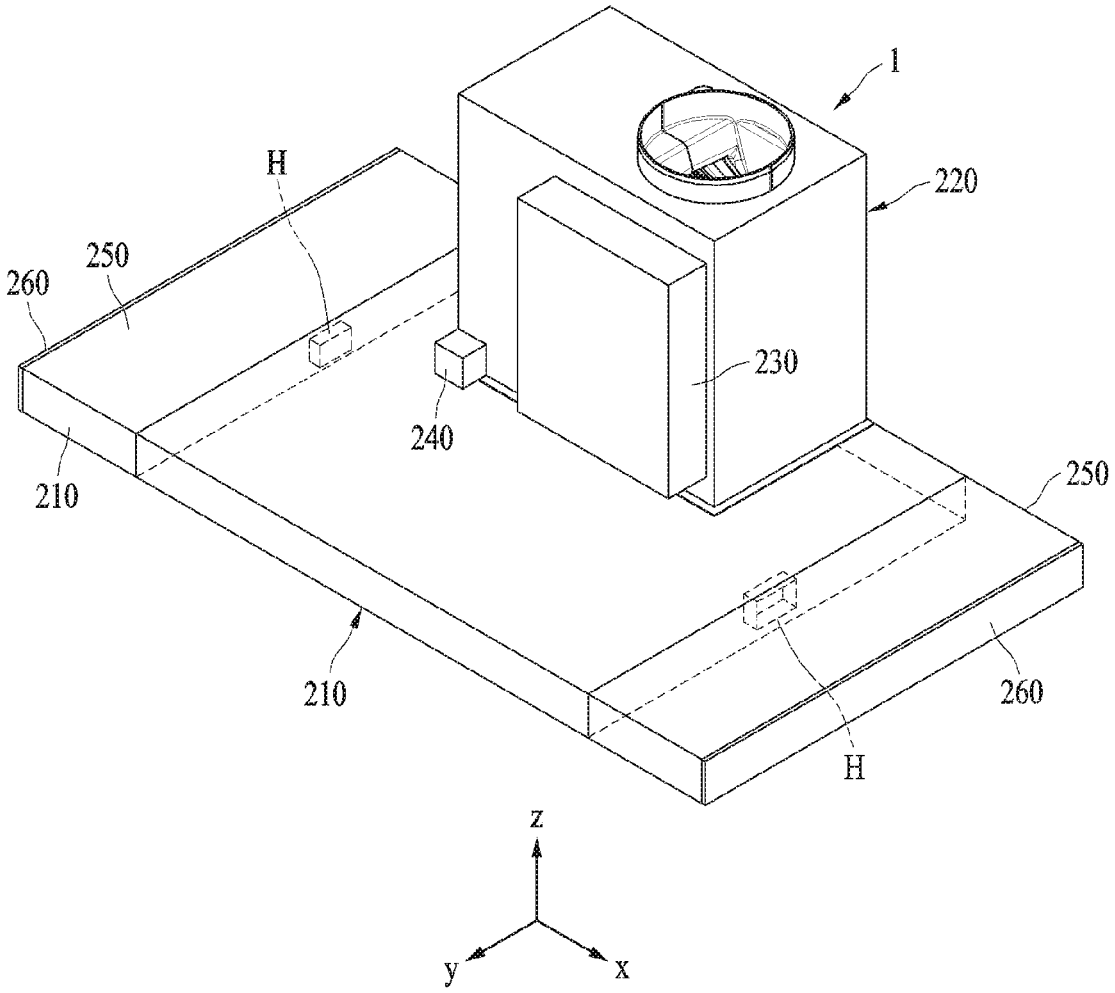
FIG. 10B is a perspective view of a hood according to an example embodiment.

FIGS. 10A and 10B are an exploded perspective view and a perspective view of the hood 1 according to an example embodiment.

Referring to FIGS. 10A and 10B, the hood 1 may include the main frame module 210 (e.g., the main frame module 110), a motor module 220 (e.g., the motor module 120), a control module 230, a dust sensor 240, an expansion module 250 and a cover module 260. The main frame module 210 (e.g., the main frame module 110) may determine an area range of air sucked into the hood 1, and the greater an area of the main frame module 210 (e.g., the main frame module 110) is, the wider the range of air that may be sucked in. The motor module 220 (e.g., the motor module 120) may include a duct 222, a motor 224, and an exhaust fan 226, and air at the upper side (e.g., the +z direction side in FIG. 1) of the cooking appliance 2 may be sucked into the duct 222 (e.g., the duct 122) through the main frame module 210 (e.g., the main frame module 110) by the exhaust fan 226 driven by the motor 224, and may be discharged to the outside through an exhaust port of the exhaust fan 226 (e.g., the exhaust fan 126). The control module 230 (e.g., the control module 130) may control whether or not the hood 1 operates and a rotation velocity of the exhaust fan 226 (e.g., the exhaust fan 126) included in the motor module 220 (e.g., the motor module 120) of the hood 1.

Referring to FIG. 10A, the main frame module 210 (e.g., the main frame module 110) may include a first surface 210*a* (e.g., the first surface 110*a*) (e.g., a surface facing a+z direction in FIG. 10A) close to the ceiling when the hood 1 is disposed to be spaced apart from the upper side (e.g., the +z direction side in FIG. 1) of the cooking appliance 2, and a second surface 210*b* (e.g., the second surface 110*b*) (e.g., a surface facing a −z direction in FIG. 10A) formed on the opposite side of the first surface 210*a* (e.g., the first surface 110*a*) so that it is close to the floor when the hood 1 is disposed to be spaced apart from the upper side (e.g., the +z direction side in FIG. 1) of the cooking appliance 2. In addition, the hood may include a third surface 210*c* (e.g., the third surface 110*c*) (e.g., a surface facing a +x direction in FIG. 10A) disposed on an outer lateral portion of the first surface 210*a* (e.g., the first surface 110*a*) and corresponding to a right surface of the main frame module 210 (e.g., the main frame module 110), a fourth surface 210*d* (e.g., the fourth surface 110*d*) (e.g., a surface facing a −x direction in FIG. 3A) disposed on an outer lateral portion of the first surface 210*a* (e.g., the first surface 110*a*) and corresponding to a left surface of the main frame module 210 (e.g., the main frame module 110), and a fifth surface 210*e* (e.g., a surface facing a +y direction in FIG. 10A) disposed on an outer lateral portion of the first surface 210*a* (e.g., the first surface 110*a*) of the main frame module 210 (e.g., the main frame module 110) and connecting the third surface 210*c* (e.g., the third surface 110*c*) and the fourth surface 210*d* (e.g., the fourth surface 110*d*) and corresponding to a front surface of the main frame module 210 (e.g., the main frame module 110).

The main frame module 210 (e.g., the main frame module 110) may include a through-hole 212 (e.g., the through-hole 112) passing through the first surface 210*a* (e.g., the first surface 110*a*) and the second surface 210*b* (e.g., the second surface 110*b*), and the motor module 220 (e.g., the motor module 120) may include the duct 222 (e.g., the duct 122), the motor 224 (e.g., the motor 124), and the exhaust fan 226 (e.g., the exhaust fan 126), and air at the upper side (e.g., the +z direction side in FIG. 1) of the cooking appliance 2 may be sucked into the duct 222 (e.g., the duct 122) through the main frame module 210 (e.g., the main frame module 110) by the exhaust fan 226 (e.g., the exhaust fan 126) driven by the motor 224 (e.g., the motor 124), and may be discharged to the outside through an exhaust port of the exhaust fan. The control module 230 may control whether or not the hood 1 operates and a rotation velocity of the exhaust fan 226 (e.g., the exhaust fan 126) included in the motor module 220 (e.g., the motor module 120) of the hood 1.

According to an example embodiment, the exhaust fan 226 (e.g., the exhaust fan 126) may be a fan with an air blowing function such as a sirocco fan, a turbo fan, a propeller fan, or a cross flow fan that generates an airflow, and desirably, a sirocco fan. More specifically, referring to FIG. 5B, the air sucked into the exhaust fan 226 (e.g., the exhaust fan 126) may flow in a direction of an arrow indicated by F1, and the air discharged to the outside of the exhaust fan 226 (e.g., the exhaust fan 126) may flow out in a direction of an arrow indicated by F2. That is, the exhaust fan 226 (e.g., the exhaust fan 126) may suck in the air in the direction parallel to an axial direction X-X of the motor 224 (e.g., the motor 124), and may exhaust the air in the direction perpendicular to the axial direction X-X of the motor 224 (e.g., the motor 124).

According to an example embodiment, the hood 1 may further include a fine dust sensor 240 disposed on the first surface 210*a* of the main frame module 210. The fine dust sensor 240 may measure a degree of pollution of the air, that is, an amount of fine dust, being sucked into the hood 1, and transmit to the control module 230 to determine whether or not to operate the hood 1 and to determine a rotation velocity of the exhaust fan 226 (e.g., the exhaust fan 126) of the hood 1.

Hereinafter, example embodiments related to a disposition of the expansion module 250 in the hood 1 are described in detail. The expansion module 250 may be a main frame extension which is attachable to and removable from the main frame, that is, removable attachable to the main frame. A respective side surface among a plurality of side surfaces of the main frame may include a first fixing member at which a main frame extension is removably attachable to the main frame, while the main frame extension may have a second fixing member engageable with the first fixing member of the respective surface. The first and second fixing members may be coupled to each other in a snap-and-sliding manner, without being limited thereto.

The cover module 260 according to an embodiment is attached to both ends of the expansion module 250 (e.g., a first coupling surface 250*a* or a second coupling surface 250*b* of the expansion module 250) to provide aesthetics of the hood and it can be customized.

Figure 11A:
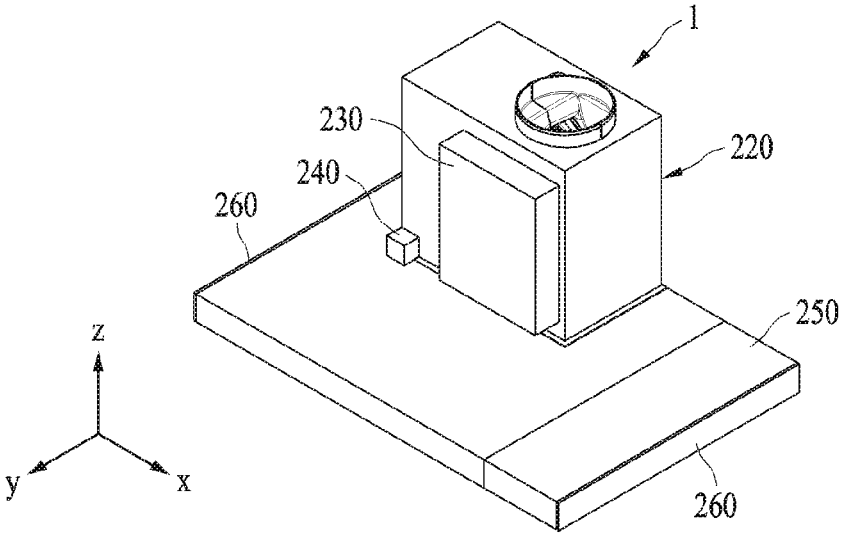
FIGS. 11A and 11B are views in which one expansion module is coupled to a third surface or a fourth surface of a main frame module according to an example embodiment.
Figure 11B:
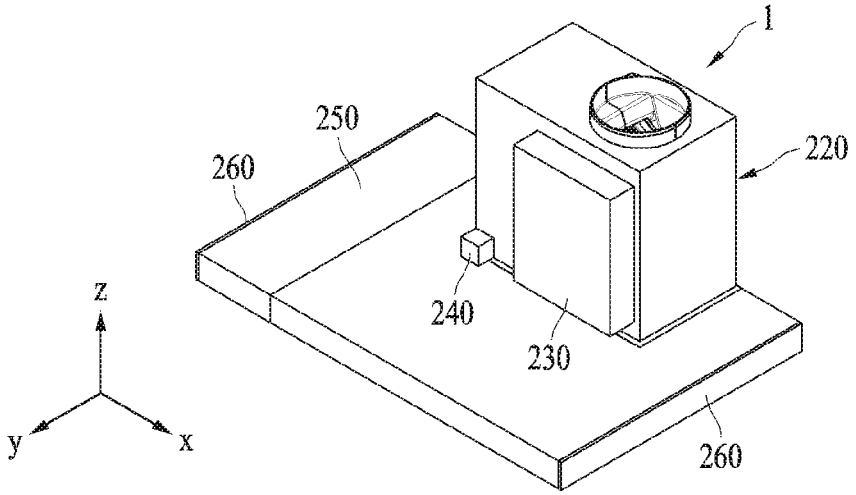
Figure 11C:
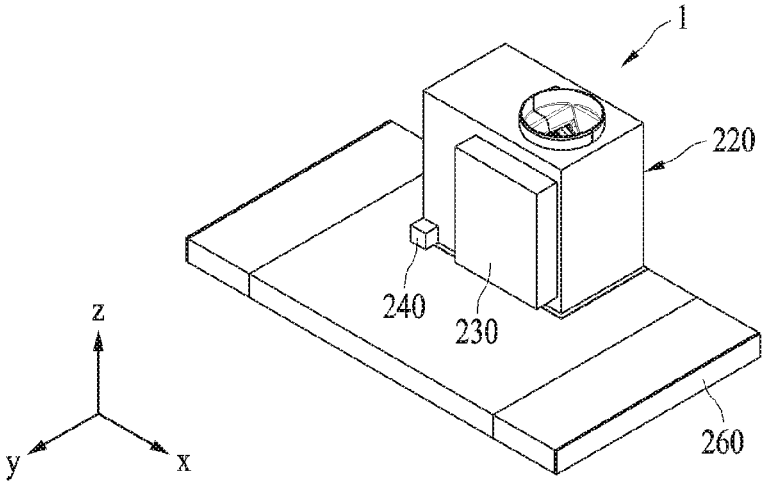
FIGS. 11C, 11D and 11E are views in which two expansion modules are coupled to a third surface or a fourth surface, or a third surface and a fourth surface of a main frame module according to an example embodiment.
Figure 11D:
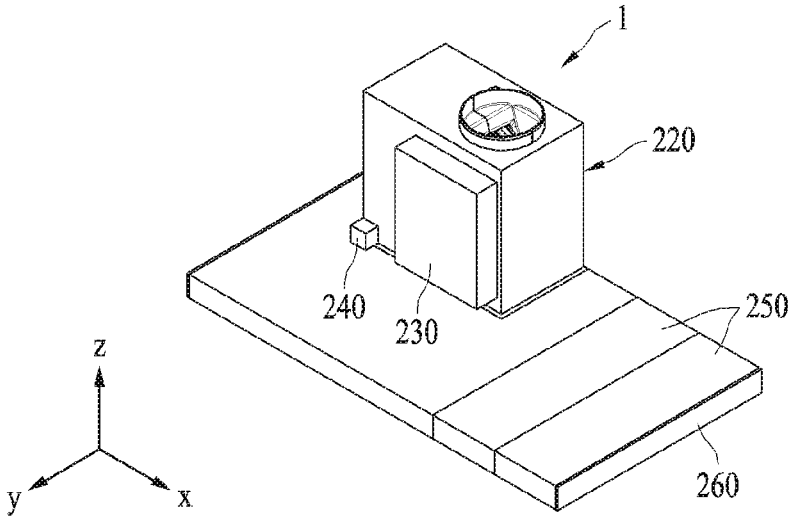
Figure 11E:
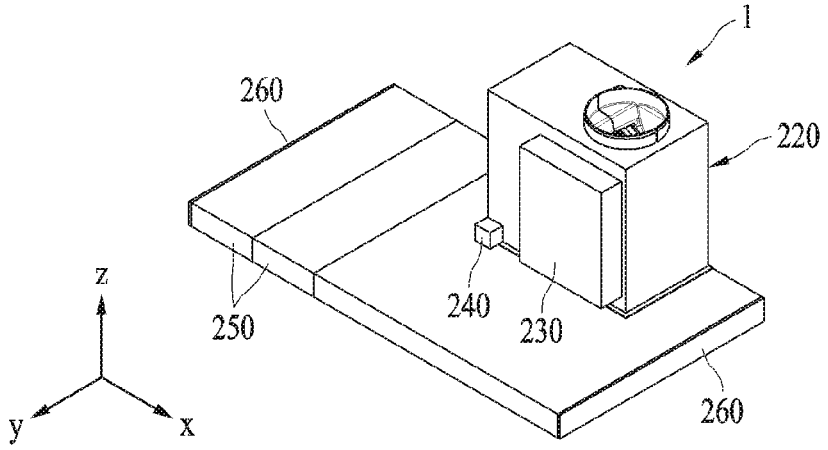
Figure 11F:
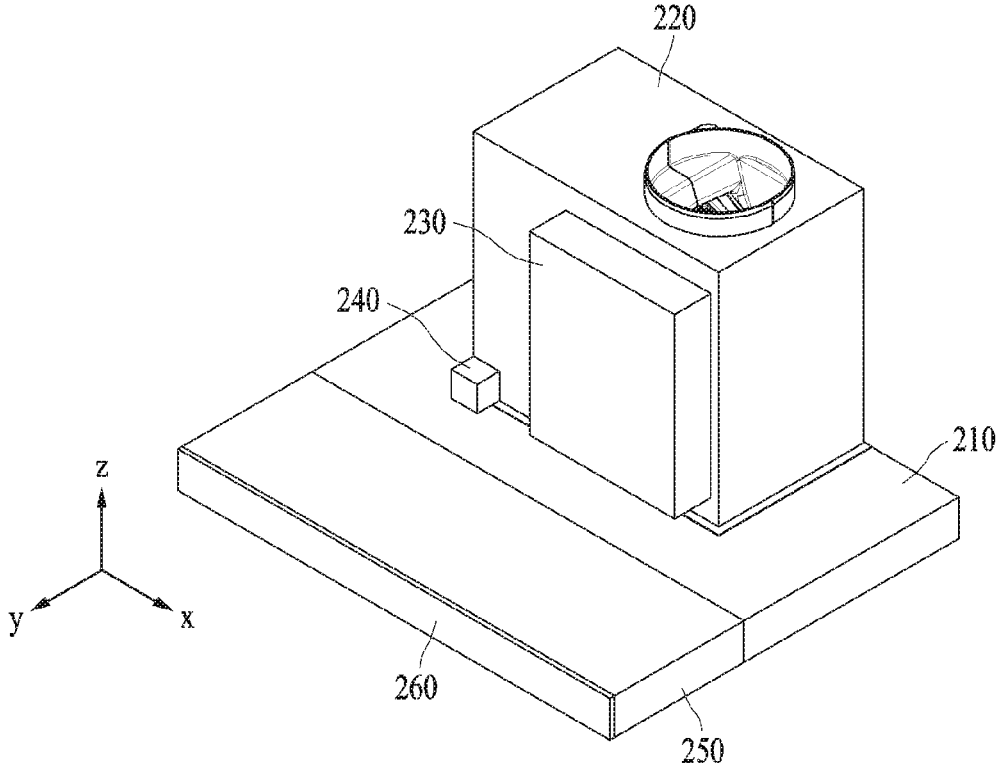
FIG. 11F is a view in which an expansion module is coupled to a fifth surface of a main frame module according to an example embodiment.

FIGS. 11A to 11B, 11C to 11E and 11F are diagrams illustrating a state in which one or more expansion module 250 according to an example embodiment is coupled to the main frame module 210 (e.g., the main frame module 110), of which FIGS. 11A and 11B are views states in which one expansion module 250 is coupled to the third surface 210*c* (e.g., the third surface 110*c*) or the fourth surface 210*d* (e.g., the fourth surface 110*d*) of the main frame module 210 (e.g., the main frame module 110) according to an example embodiment, FIGS. 11C to 11E are views of states in which two expansion modules 250 are coupled to the third surface 210*c* (e.g., the third surface 110*c*) or the fourth surface 210*d* (e.g., the fourth surface 110*d*), or to the third surface and the fourth surface 210*c* and 210*d* (e.g., the third surface and the fourth surface 110*c* and 110*d*) of the main frame module 210 (e.g., the main frame module 110) according to an example embodiment, and FIG. 11F is a view of a state in which the expansion module 250 is coupled to a fifth surface 210*e* of the main frame module 210 (e.g., the main frame module 110) according to an example embodiment.

Referring to FIGS. 11A to 11F, the hood 1 may further include one or more expansion module 250, and the expansion module 250 may be disposed on the third surface 210*c* (e.g., the third surface 110*c*) or the fourth surface 210*d* (e.g., the fourth surface 110*d*) or the fifth surface 210*e* of the main frame module 210 (e.g., the main frame module 110), or on a first coupling surface 250*a* or a second coupling surface 250*b* of another expansion module. As described above, when the hood 1 in which the expansion module 250 is coupled to the main frame module 210 (e.g., the main frame module 110) is installed on the upper side (e.g., the +z direction side in FIG. 1) of the cooking appliance 2 having various sizes and the ability to be placed in various positions, it may be easy to place the hood (1) at a position desired by the consumer or at a position where the suction performance of the hood (1) may be maximized, and even in the process of manufacturing the hood 1, it may be possible to flexibly respond to the cooking appliance 2 having various sizes and the ability to be placed in various positions, and thereby reduce manufacturing costs. The cover module 260 according to an embodiment is attached to both ends of the expansion module 250 to provide aesthetics of the hood and it can be customized. In an embodiment, the hood 1 may further include a fine dust sensor 240.

Hereinafter, various assembly structures disposed in the main frame module 210 (e.g., the main frame module 110) and the expansion module 250 according to an example embodiment are described in detail.

FIGS. 12A to 12D are views of a bracket A1 having a first assembly structure and a bracket A2 having a second assembly structure according to an example embodiment.

The first surface 210*a* and a third surface disposed on the outer lateral portion of the second surface 210*b* of the main frame module 210 (e.g., the main frame module 110) of the hood 1 may include the bracket A1 having the first assembly structure. That is, the side surface (e.g., the third surface) may include the bracket A1 and the first assembly structure. For example, the above-mentioned third surface of the main frame module 210 (e.g., the main frame module 110) may be the third surface 210*c* (e.g., the third surface 110*c*) (see FIG. 10A).

Figure 12A:
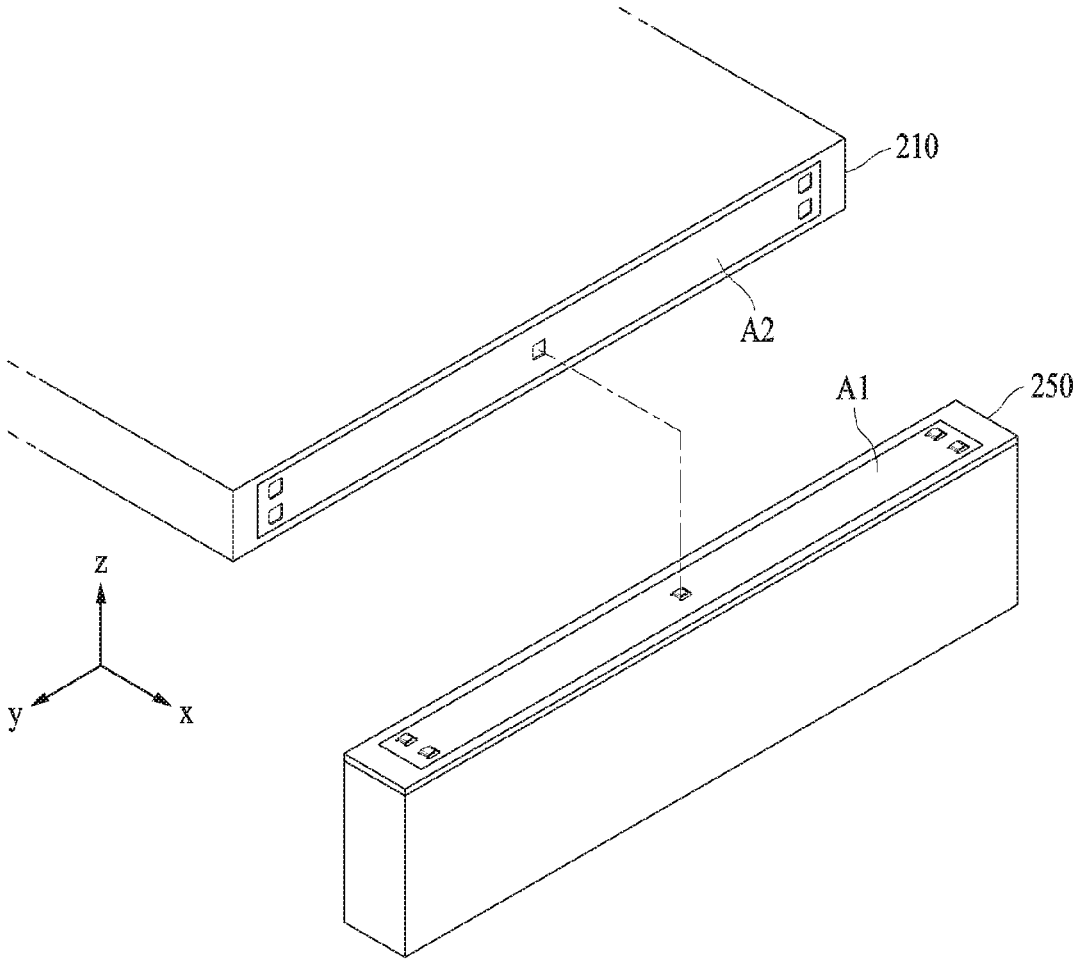
FIG. 12A is a view illustrating a state in which a bracket having a first assembly structure and a bracket having a second assembly structure are coupled to a main frame module and an expansion module, respectively, according to an example embodiment.
Figure 12B:
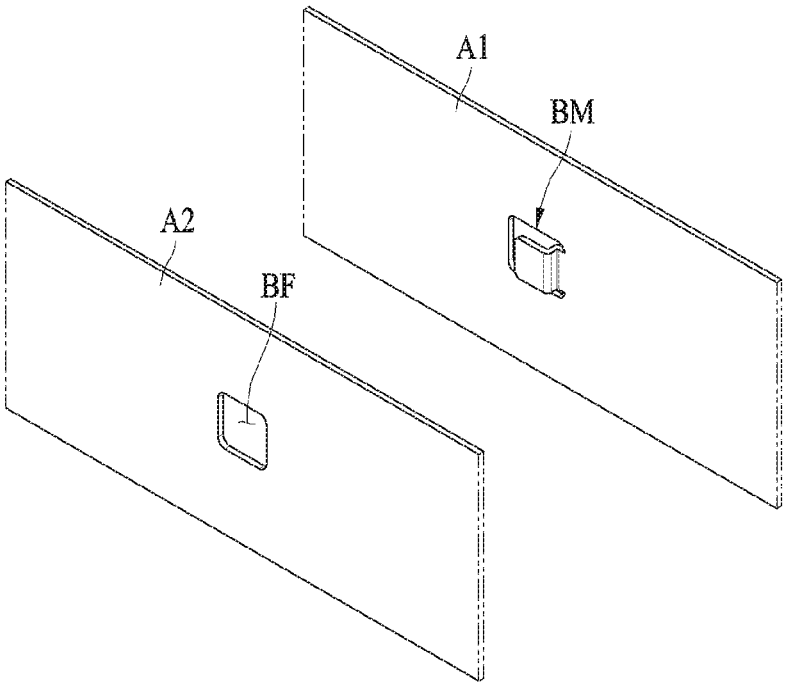
FIG. 12B is an enlarged view of a bracket having a male assembly structure and a bracket having a female assembly structure according to an example embodiment.

The fourth surface 210*d* (e.g., the fourth surface 110*d*) of the main frame module 210 (e.g., the main frame module 110) may include the bracket A2 having the second assembly structure (see FIG. 10A). That is, the side surface (e.g., the fourth surface 110*d*) may include the bracket A2 and the second assembly structure. In addition, the fifth surface 210*e* of the main frame module 210 (e.g., the main frame module 110) of the hood 1 may include any one of the bracket A1 having the first assembly structure or the bracket A2 having the second assembly structure. Referring to FIG. 12B, the first assembly structure may include one of a male assembly structure BM or a female assembly structure BF, and the second assembly structure may include one of a male assembly structure BM or a female assembly structure BF different from that included in the first assembly structure.

The expansion module 250 may include the first coupling surface 250*a* and the second coupling surface 250*b*. The first coupling surface 250*a* and the second coupling surface 250*b* of the expansion module 250 may be coupled to the third surface 210*c* (e.g., the third surface 110*c*), the fourth surface 210*d* (e.g., the fourth surface 110*d*), or the fifth surface 210*e* of the main frame module 210 (e.g., the main frame module 110). In such case, the first coupling surface 250*a* of the expansion module 250 may include a bracket having an assembly structure corresponding to one of the male assembly structure BM or the female assembly structure BF of the third surface 210*c* (e.g., the third surface 110*c*) of the main frame module 210 (e.g., the main frame module 110), and the second coupling surface 250*b* of the expansion module 250 may include a bracket having an assembly structure corresponding to one of the male assembly structure BM or the female assembly structure BF of the fourth surface 210*d* (e.g., the fourth surface 110*d*) of the main frame module 210 (e.g., the main frame module 110).

Figure 12C:
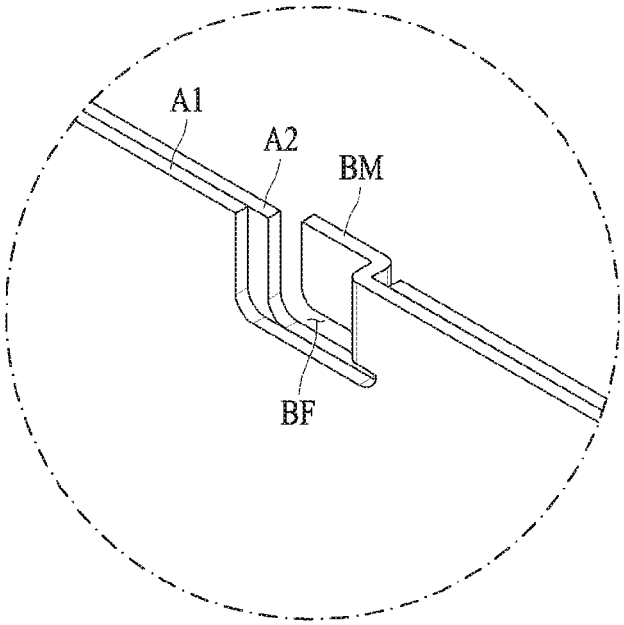
FIG. 12C is a view illustrating a state before a bracket having a male assembly structure and a bracket having a female assembly structure are overlapped and coupled according to an example embodiment.
Figure 12D:
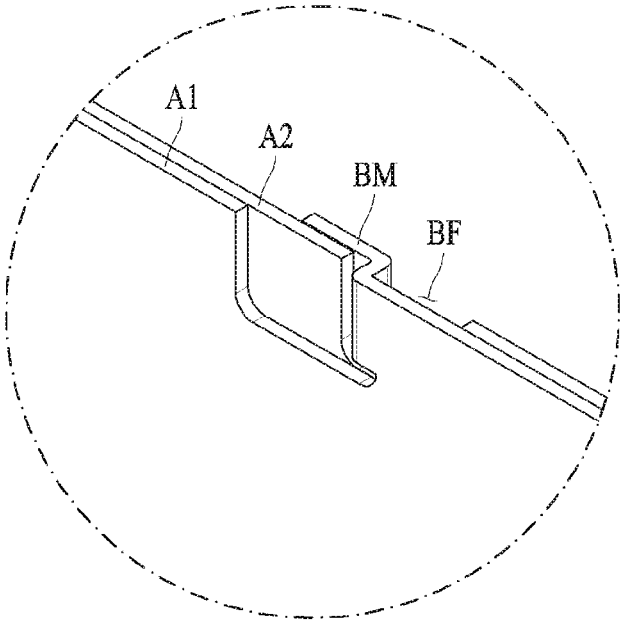
FIG. 12D is a view illustrating a state after a bracket having a male assembly structure and a bracket having a female assembly structure are overlapped and coupled according to an example embodiment.

In addition, the bracket having the male assembly structure BM or the female assembly structure BF may be coupled by a magnetic coupling scheme, a snap-fit coupling scheme, an interference fit coupling scheme, or a snap-and-sliding scheme, and desirably, by a snap-and-sliding scheme. However, the bracket having the male assembly structure BM or the female assembly structure BF is not limited to the above-described coupling schemes, and may include all other coupling schemes that may easily be conceived by one of ordinary skill in the art. Referring to FIGS. 12C and 12D, the bracket A1 having the first assembly structure and the bracket A2 having the second assembly structure according to an example embodiment may be coupled to each other by the snap-and-sliding scheme. In such case, after the male assembly structure BM included in the bracket A1 having the first assembly structure is snapped to fit into the female assembly structure BF included in the bracket A2 having the second assembly structure, the brackets A1 and A2 may be coupled to each other by sliding the brackets A1 and A2 in a direction parallel to each other.

The description of the expansion module 250 above is based on the assumption that the module is a basic expansion module 250 that does not include any functional units. Hereinafter, an expansion module 252 including various functional units is described in detail.

Figure 13:
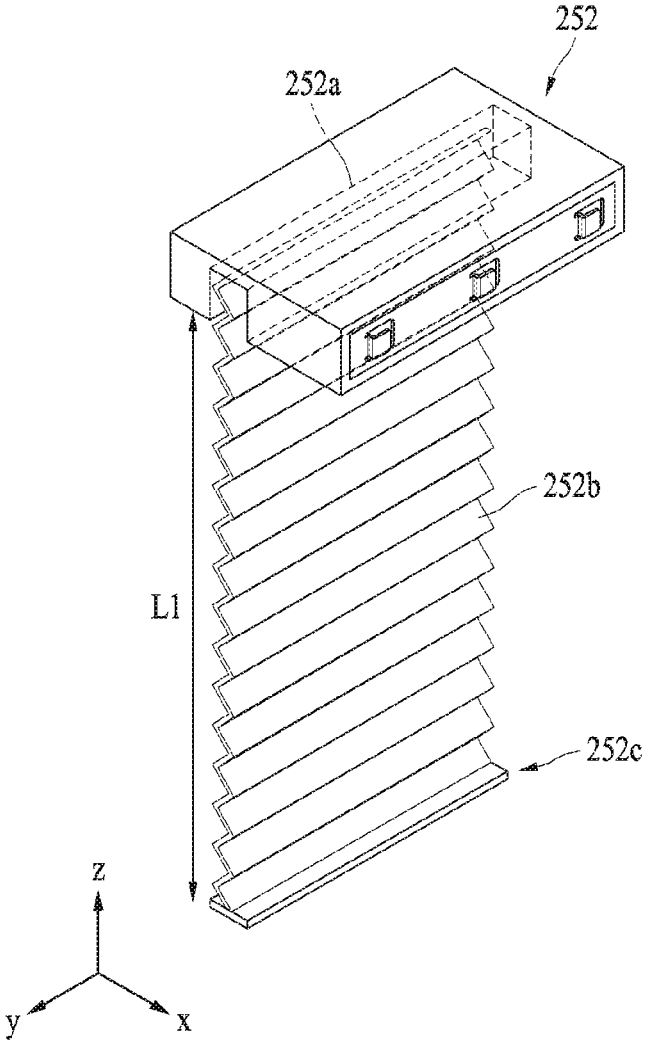
FIG. 13 is a plan perspective view including a cross-section of an expansion module including a side-wall unit according to an example embodiment.

FIG. 13 is a plan perspective view including a cross-section of the expansion module 252 (e.g., the expansion module 250) including a side-wall unit according to an example embodiment.

Referring to FIG. 13, the side-wall unit of the expansion module 252 (e.g., the expansion module 250) may include a case 252*a*, a side-wall 252*b*, and a cover-wall 252*c*. The case 252*a* may serve to store the side-wall 252*b* when the side-wall 252*b* is not in use, and the side-wall 252*b* may serve as a physical barrier for improving the suction performance of the hood 1. In addition, the side-wall 252*b* may prevent contaminants generated during cooking in the heating part 21 of the cooking appliance 2 from escaping the cooking appliance 2. The side-wall 252*b* may extend vertically downward from a bottom surface (a surface facing a −z direction in FIG. 13) of the expansion module 252 (e.g., the expansion module 250). Accordingly, the side-wall 252*b* may effectively prevent contaminants generated during cooking from escaping the cooking appliance 2 and may improve the suction performance of the hood 1.

The length of the side-wall 252*b* of the expansion module 252 (e.g., the expansion module 250) may be extended to a first length L1. In such case, the first length L1 of the side-wall 252*b* may be about 350 mm or more, and desirably about 350 mm or more and about 450 mm or less. When the first length L1 of the side-wall 252*b* is about 350 mm or more and about 450 mm or less, the escape rate may be the lowest (see FIG. 9). The escape rate may be a rate at which polluted air, smoke, or odor generated from food is not discharged to the outside through the hood 1 and leaks. That is, since the escape rate is the lowest in the above-mentioned length range, the suction performance of the hood 1 may be maximized when the side-wall 252*b* falls within the above-mentioned length range.

Referring again to FIG. 13, one surface of the expansion module 252 (e.g., the expansion module 250) may include a bracket A1 or A2 having an assembly structure BF or BM corresponding to one of the male assembly structure BM or the female assembly structure BF of the third surface 210*c* (e.g., the third surface 110*c*) of the main frame module 210 (e.g., the main frame module 110), and the other surface of the expansion module 252 (e.g., the expansion module 250) may include a bracket A1 or A2 having an assembly structure BF or BM corresponding to one of the male assembly structure BM or the female assembly structure BF of the fourth surface 210*d* (e.g., the fourth surface 110*d*) of the main frame module 210 (e.g., the main frame module 110).

Figure 14:
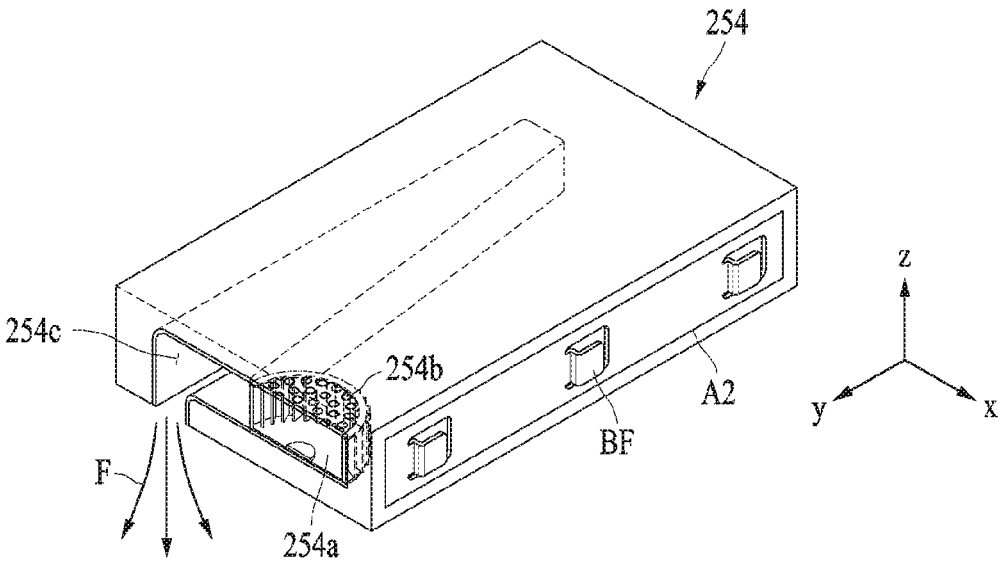
FIG. 14 is a plan perspective view including a cross-section of an expansion module including an air curtain unit according to an example embodiment.

FIG. 14 is a plan perspective view including a cross-section of an expansion module 254 (e.g., the expansion module 250) including an air curtain units according to an example embodiment.

Referring to FIG. 14, the air curtain unit of the expansion module 254 (e.g., the expansion module 250) may include a fan 254*a* that forms a flow of air, an air intake port 254*b*, and a discharge duct 254*c* including an opening. The air curtain unit may serve as a barrier preventing contaminants from leaking out of an area range of the second surface 210*b* (e.g., the second surface 110*b*) of the main frame module 210 (e.g., the main frame module 110) of the hood 1 from under the hood 1, by discharging air strongly through the opening of the discharge duct 254*c*, like the side-wall units 252*a* to 252*c*. The air may be sucked into the expansion module 254 (e.g., the expansion module 250) through the air intake port 254*b* and may leak through the opening of the discharge duct 254*c* along a moving direction F of the air flow formed by the fan 254*a*.

Referring again to FIG. 14, one surface of the expansion module 254 (e.g., the expansion module 250) may include a bracket A1 or A2 having an assembly structure BF or BM corresponding to one of the male assembly structure BM or the female assembly structure BF of the third surface 210*c* (e.g., the third surface 110*c*) of the main frame module 210 (e.g., the main frame module 110), and the other surface of the expansion module 254 (e.g., the expansion module 250) may include a bracket A1 or A2 having an assembly structure BF or BM corresponding to one of the male assembly structure BM or the female assembly structure BF of the fourth surface 210*d* (e.g., the fourth surface 110*d*) of the main frame module 210 (e.g., the main frame module 110).

Figure 15A:
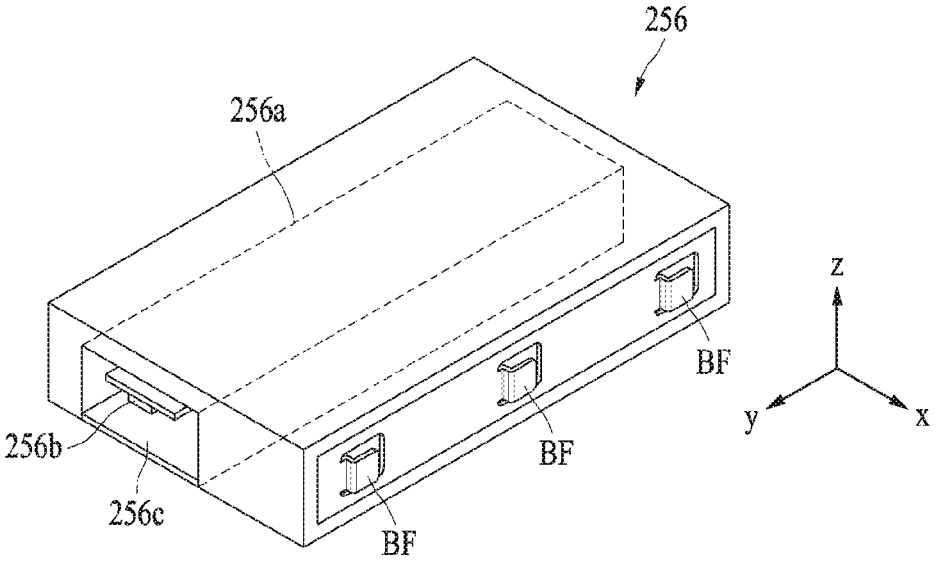
FIG. 15A is a plan perspective view including a cross-section of an expansion module including a lighting unit according to an example embodiment.
Figure 15B:
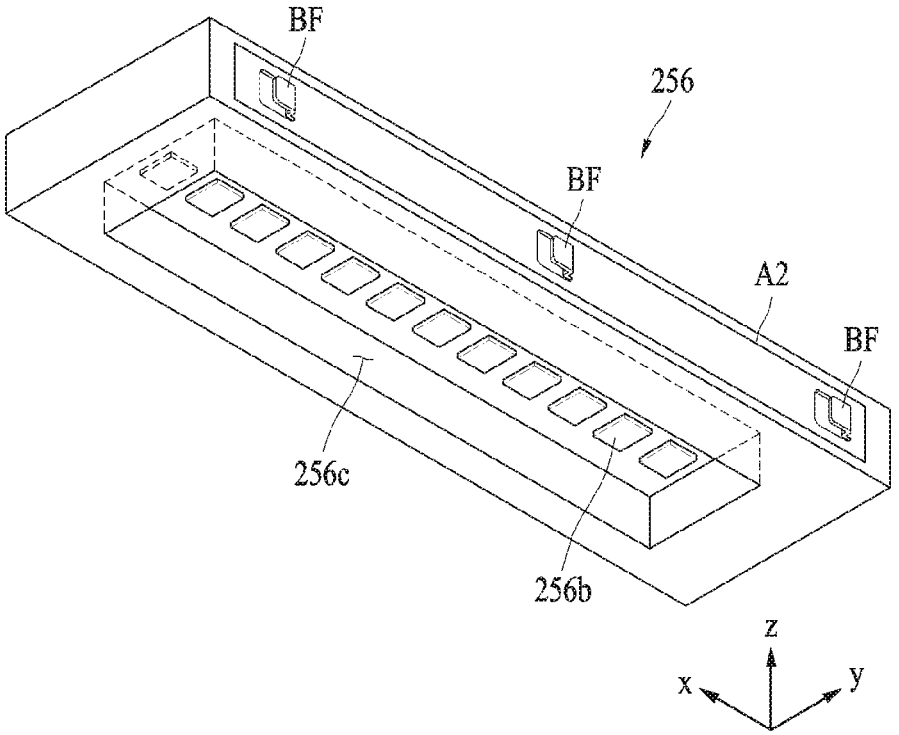
FIG. 15B is a bottom perspective view of an expansion module including a lighting unit according to an example embodiment.

FIG. 15A is a plan perspective view including a cross-section of an expansion module 256 (e.g., the expansion module 250) including a lighting unit according to an example embodiment, and FIG. 15B is a bottom perspective view of the expansion module 256 (e.g., the expansion module 250) including the lighting unit according to an example embodiment.

Referring to FIGS. 15A and 15B, the lamp unit may include a lamp holder 256*a*, a lamp 256*b* coupled to the lamp holder 256*a*, and a lamp cover 256*c* coupled to the lamp holder 256*a* and made of a transparent or translucent material to scatter the light of the lamp 256*b*. The lamp unit may illuminate the heating part 21 or a peripheral portion of the heating part 21 when food is cooked on the cooking appliance 2 to increase user convenience.

Referring again to FIGS. 15A and 15B, one surface of the expansion module 256 (e.g., the expansion module 250) may include a bracket A1 or A2 having an assembly structure BF or BM corresponding to one of the male assembly structure BM or the female assembly structure BF of the third surface 210*c* (e.g., the third surface 110*c*) of the main frame module 210 (e.g., the main frame module 110), and the other surface of the expansion module 256 (e.g., the expansion module 250) may include a bracket A1 or A2 having an assembly structure BF or BM corresponding to one of the male assembly structure BM or the female assembly structure BF of the fourth surface 210*d* (e.g., the fourth surface 110*d*) of the main frame module 210 (e.g., the main frame module 110).

Figure 16A:
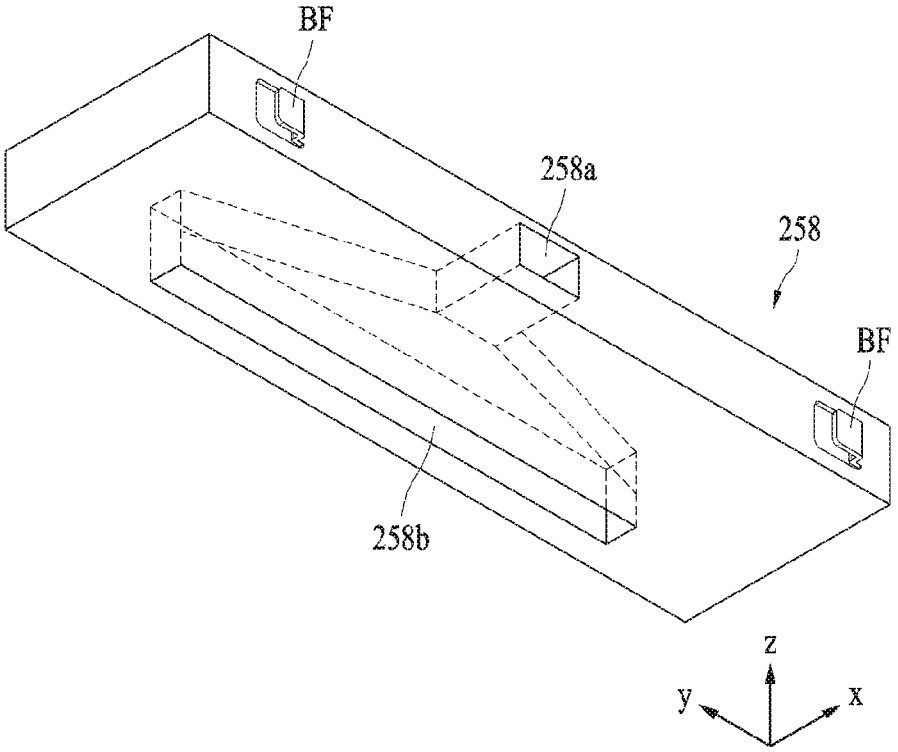
FIG. 16A is a view illustrating an expansion module including a suction duct unit according to an example embodiment.
Figure 16B:
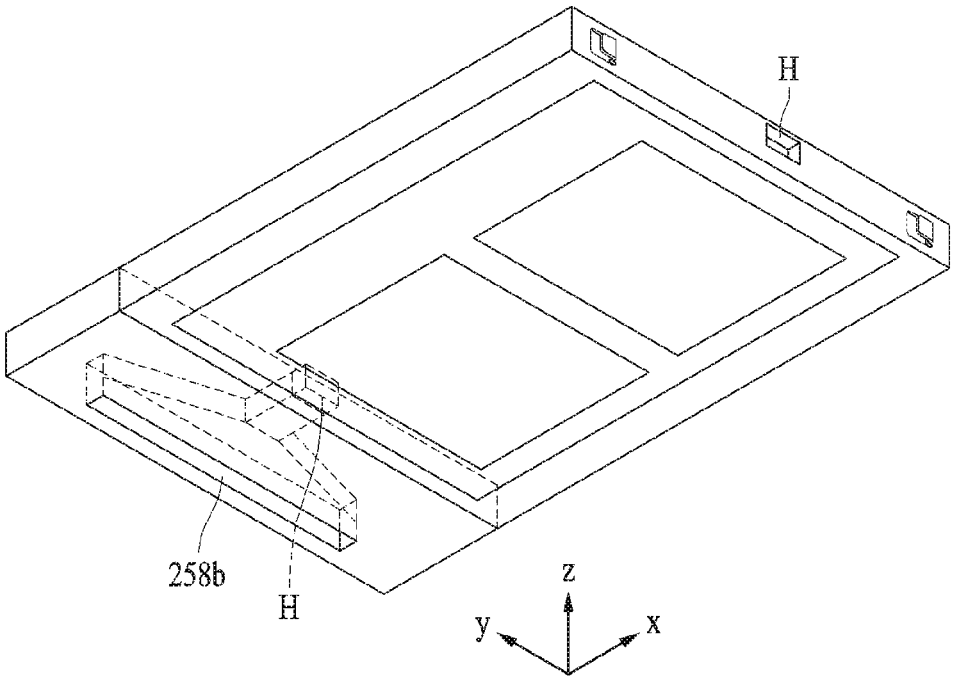
FIG. 16B is a view illustrating a state in which an expansion module including a suction duct unit is coupled to a main frame module according to an example embodiment.

FIG. 16A is a view of an expansion module 258 (e.g., the expansion module 250) including a suction duct unit according to an example embodiment, and FIG. 16B is a view illustrating a state in which the expansion module 258 (e.g., the expansion module 250) including the suction duct unit is coupled to the main frame module.

Referring to FIGS. 16A and 16B, the expansion module 258 (e.g., the expansion module 250) may include the suction duct unit. The suction duct units 258*a* and 258*b* may include an opening 258*a* formed on any one of a first coupling surface (e.g., the first coupling surface 250*a*) or a second coupling surface (e.g., the second coupling surface 250*b*) of the expansion module 258 (e.g., the expansion module 250) and the suction duct 258*b* which can fluidically communicate with the opening 258*b*. The suction duct units 258*a* and 258*b* may extend an area range of the air being sucked into the hood 1 to an area of the duct 258*b* in addition to the area of the through-hole 212 (e.g., the through-hole 112) of the main frame module 210 (e.g., the main frame module 110). That is, when an area of the cooking appliance 2 is greater than the size of the hood 1 which is a basic type of hood, the expansion module 258 (e.g., the expansion module 250) may be disposed to expand the area range of the air being sucked in.

Referring again to FIG. 16B, the main frame module 210 (e.g., the main frame module 110) may further include an opening H formed on the third surface 210*c* (e.g., the third surface 110*c*) or the fourth surface 210*d* (e.g., the fourth surface 110*d*), and an opening H of the main frame module 210 (e.g., the main frame module 110) and the opening 258*a* of the expansion module 258 (e.g., the expansion module 250) may be connected to each other. The flow of air sucked in by the exhaust fan 226 (e.g., the exhaust fan 126) through a connection structure of the opening H and the opening 258*a* may be led to the duct 258*b* of the expansion module 258 (e.g., the expansion module 250).

One surface of the expansion module 258 (e.g., the expansion module 250) may include a bracket A1 or A2 having an assembly structure BF or BM corresponding to one of the male assembly structure BM or the female assembly structure BF of the third surface 210*c* (e.g., the third surface 110*c*) of the main frame module 210 (e.g., the main frame module 110), and the other surface of the expansion module 258 (e.g., the expansion module 250) may include a bracket A1 or A2 having an assembly structure BF or BM corresponding to one of the male assembly structure BM or the female assembly structure BF of the fourth surface 210*d* (e.g., the fourth surface 110*d*) of the main frame module 210 (e.g., the main frame module 110).

Figure 17:
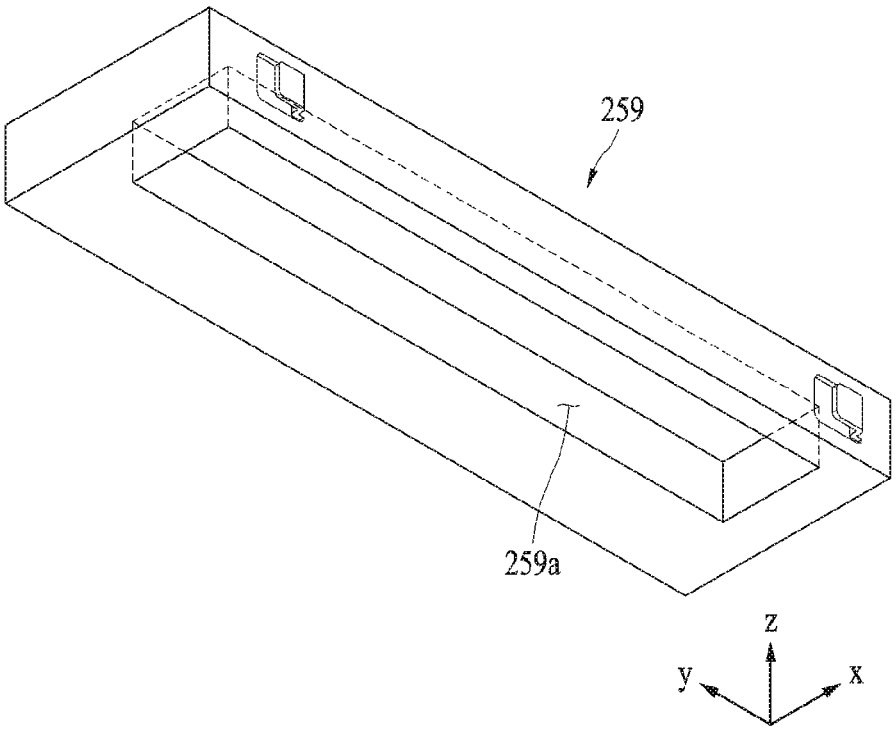
FIG. 17 is a view illustrating an expansion module including a holder according to an example embodiment.

FIG. 17 is a view illustrating an expansion module 259 (e.g., the expansion module 250) including a holder 259*a* to which different functional units can be detached/attached according to an example embodiment.

The expansion module 259 (e.g., the expansion module 250) may be fixedly coupled with a unit having any one function, and may include the holder 259*a* to which any one of the above-described functional units or functional units having advantageous effects on the operation of the hood can be detached/attached. In such case, the functional unit may include any one of a suction range extension unit, a lighting unit, a side-wall unit, and an air curtain unit.

According to an example embodiment, a hood 1 includes a main frame module 110 including a first surface 110*a* and a second surface 110*b* formed on an opposite side of the first surface 110*a*, and a through-hole 112 passing through the first surface 110*a* and the second surface 110*b*, a motor module 120 including a duct 122, a motor 124, and an exhaust fan 126 driven by the motor 124, the blowing direction of the exhaust fan 126 being perpendicular to an axis of the motor 124, the motor module 120 being disposed on the first surface 110*a* of the main frame module 110, facing the second surface 110*b* of the main frame module 110 to suck in air through the through-hole 112 of the main frame module 110, and a control module 130 that controls whether the hood 1 operates and controls a rotation velocity of the exhaust fan 126 included in the motor module 120 of the hood 1, wherein the axis of the motor 124 of the motor module 120 may be disposed in a direction from a front surface to a rear surface of the hood 1, and the control module 130 may be disposed on the first surface 110*a* of the main frame module 110.

In an example embodiment, the main frame module 110 may include one or more bracket frame 116 disposed on the second surface 110*b* of the main frame module 110 and protruding in a direction perpendicular to the second surface 110*b*, and the one or more bracket frame 116 may compartmentalize one area of the second surface 110*b* including the through-hole 112 of the main frame module 110 and another area of the second surface 110*b* not including the through-hole 112 of the main frame module 110 (e.g., a remaining area).

In an example embodiment, the hood 1 may further include a fine dust sensor 140 disposed on the first surface 110*a* of the main frame module 110, wherein the control module 130 may be set to turn on a power of the hood 1 when fine dust of a first concentration or higher is detected by the fine dust sensor 140, and to turn off the power of the hood 1 when the fine dust of the first concentration or lower is detected by the fine dust sensor 140.

In an example embodiment, the hood 1 may further include a fine dust sensor 140 disposed on the first surface 110*a* of the main frame module 110, wherein the control module 130 may increase the rotation velocity of the exhaust fan 126 included in the motor module 120 of the hood 1 when fine dust of a second concentration or higher is detected by the fine dust sensor 140, and reduce the rotation velocity of the exhaust fan 126 included in the motor module 120 of the hood 1 when the fine dust of the second concentration or lower is detected by the fine dust sensor 140.

In an example embodiment, the hood 1 may further include a fine dust sensor 140 disposed on the first surface 110*a* of the main frame module 110, and a side-wall module 150 disposed on an outer lateral portion of the first surface 110*a* or the second surface 110*b* of the main frame module 110 and including a side-wall 154, wherein the control module 130 may extend a length of the side-wall 154 of the side-wall module 150 to a first length when fine dust of a third concentration or higher is detected by the fine dust sensor 140, and may reduce a length of the side-wall 154 of the side-wall module 150 to a second length when the fine dust of the third concentration or lower is detected by the fine dust sensor 140.

In an example embodiment, the first length L1 of the side-wall 154 may be about 350 mm or more and about 450 mm or less.

In an example embodiment, when the power of the hood 1 is turned off, the side-wall 154 may return to an initial position.

In an example embodiment, the main frame module 110 may include a lamp unit 118 disposed in a front and rear of the through-hole 112.

According to an example embodiment, a hood 1 includes a main frame module 210 including a first surface 210*a* and a second surface 210*b* formed on an opposite side of the first surface 210*a*, and a through-hole 212 passing through the first surface 210*a* and the second surface 210*b*, a motor module 220 including a duct 222, a motor 224, and an exhaust fan 226 driven by the motor 224, the blowing direction of the exhaust fan 226 being perpendicular to an axis of the motor 224, the motor module 220 being disposed on the first surface 210*a* of the main frame module 210 facing the second surface 210*b* of the main frame module 210 to suck in air through the through-hole 212 of the main frame module 210, and a control module 230 that controls whether the hood 1 operates and controls a rotation velocity of the exhaust fan 226 included in the motor module 220 of the hood 1, wherein a third surface 210*c* disposed on an outer lateral portion of the first surface 210*a* of the main frame module 210 may include a bracket A1 having a first assembly structure.

In an example embodiment, a fourth surface 210*d* disposed on an outer lateral portion of the first surface 210*a* and disposed on an opposite side of the third surface 210*c* may include a bracket A2 having a second assembly structure, and a fifth surface 210*e* joining the third surface 210*c* and the fourth surface 210*d* may include any one of a bracket A1 having a first assembly structure or a bracket A2 having a second assembly structure.

In an example embodiment, the first assembly structure may include any one of a male or a female assembly structure (BM or BF), and the second assembly structure may include one of a male or a female assembly structure (BM or BF) different from an assembly structure of the first assembly structure.

In an example embodiment, the hood 1 may further include one or more expansion module 250, wherein the one or more expansion module 250 is disposed on the third surface 210*c* or the fourth surface 210*d* of the main frame module 210, or disposed on a first coupling surface 250*a* or a second coupling surface 250*b* of different expansion modules 250, and the first coupling surface 250*a* of the expansion module 250 coupled to the third surface 210*c* of the main frame module 210 may include a bracket having an assembly structure corresponding to one of a male or female assembly structure (BM or BF) of the third surface 210*c*, and the second coupling surface 250*b* of the expansion module 250 coupled to the fourth surface 210*d* of the main frame module 210 may include a bracket having an assembly structure corresponding to one of a male or a female assembly structure (BM or BF) of the fourth surface 210*d*.

In an example embodiment, the bracket having the male or female assembly structure (BM or BF) may be coupled in a snap-and-sliding manner.

In an example embodiment, the expansion module 252 may include a side-wall 252*b*, and the side-wall 252*b* extends in a direction perpendicular to and parallel to the second surface 210*b* of the main frame module 210 in the expansion module 252.

In an example embodiment, the expansion module 254 may include a fan 254*a* that forms a flow of air, an air intake port 254*b* and a discharge duct 254*c* including an opening, and air sucked into the air intake port 254*b* may flow out through the opening of the discharge duct 254*c* along a moving direction of the air flow formed by the fan 254*a*.

In an example embodiment, the expansion module 256 may include a lamp holder 256*a*, a lamp 256*b* coupled to the lamp holder 256*a*, and a lamp cover 256*c* coupled to the lamp holder 256*a* and made of a transparent or translucent material to scatter the light of the lamp 256*b*.

In an example embodiment, the expansion module 258 may include an opening 258*a* formed in any one of the first coupling surface 258*a* or the second coupling surface 258*b* of the expansion module 258, and a suction duct 258*b* which can fluidically communicate with the opening 258*a*, and the main frame module 210 may further include an opening H formed on the third surface 210*c* or the fourth surface 210*d*, and the opening H of the main frame module 210 and the opening H of the expansion module 258 may be connected to each other.

In an example embodiment, the expansion module 350 may include a holder 352 to which different functional units can be detached/attached.

In an example embodiment, the functional unit may include any one of a suction range extension unit, a lighting unit, a side-wall unit, and an air curtain unit.

According to an example embodiment, a hood 1 includes a main frame module 210 including a first surface 210*a* and a second surface 210*b* formed on an opposite side of the first surface 210*a*, and a through-hole 212 passing through the first surface 210*a* and the second surface 210*b*, a motor module 220 including a duct 222, a motor 224, and an exhaust fan 226 driven by the motor 224, the blowing direction of the exhaust fan 226 being perpendicular to an axis of the motor 224, the motor module 220 being disposed on the first surface 210*a* of the main frame module 210, facing the second surface 210*b* of the main frame module 210 to suck in air through the through-hole 212 of the main frame module 210, a control module 230 that controls whether the hood 1 operates and controls a rotation velocity of the exhaust fan 226 included in the motor module 220 of the hood 1, and one or more expansion module 250 coupled in a direction parallel to the first surface 210*a* of the main frame module 210 such as to be coplanar therewith, wherein the one or more expansion module 250 may be connected to the main frame module 210 or connected to another expansion module 250.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents.

Accordingly, other implementations are within the scope of the following claims.

What is claimed is:

1. A ventilation hood comprising:

a main frame module which faces an appliance accessible from a front of the appliance, the main frame module comprising:

a first surface, a second surface opposite to the first surface, a third surface which if perpendicular to the first surface and disposed on an outer lateral portion of the first surface, the third surface comprising a bracket extended from the front of the appliance to a rear of the appliance which is opposite to the front, the bracket of the main frame module having a first assembly structure, and a through-hole passing through the first surface and the second surface;

an expansion module removably attachable to the main frame module, the expansion module comprising:

a bracket extended from the front of the appliance to the rear of the appliance and having an assembly structure at which the expansion module removably attaches to the first assembly structure of the bracket of the main frame module, and a coupling surface of which the bracket is comprised;

a motor module disposed on the first surface of the main frame module and configured to suck in air through the through-hole of the main frame module, the motor module comprising a duct, a motor having an axis, and an exhaust fan which is driven by the motor and defines a blowing direction of the exhaust fan perpendicular to the axis of the motor; and a controller configured to control operation of the ventilation hood and a rotation velocity of the exhaust fan in the motor module.

2. The ventilation hood of claim 1, wherein the main frame module comprises one or more bracket frames disposed on the second surface of the main frame module and protruding in a direction perpendicular to the second surface, and the one or more bracket frames are configured to compartmentalize one area of the second surface comprising the through-hole of the main frame module and a remaining area of the second surface except for the through-hole.

3. The ventilation hood of claim 1, further comprising:

a dust sensor disposed on the first surface of the main frame module, wherein the controller is configured to:

turn on a power of the ventilation hood in response to dust of higher than a first concentration detected by the dust sensor, and turn off the power of the ventilation hood in response to the dust of the first concentration or lower detected by the dust sensor.

4. The ventilation hood of claim 1, further comprising:
a dust sensor disposed on the first surface of the main frame module, and
wherein the controller is configured to:
increase the rotation velocity of the exhaust fan comprised in the motor module of the ventilation hood in response to dust of higher than a second concentration detected by the dust sensor, and
reduce the rotation velocity of the exhaust fan comprised in the motor module of the ventilation hood in response to the dust of the second concentration or lower detected by the dust sensor.

5. The ventilation hood of claim 1, further comprising:
a dust sensor disposed on the first surface of the main frame module; and
a side-wall module disposed on the outer lateral portion of the first surface or the second surface of the main frame module and comprising a side-wall;
wherein the controller is configured to:
extend a length of the side-wall of the side-wall module to a first length in response to dust of higher than a third concentration detected by the dust sensor, and
reduce a length of the side-wall of the side-wall module to a second length in response to the dust of the third concentration or lower detected by the dust sensor.

6. The ventilation hood of claim 5, wherein the first length of the side-wall is greater than or equal to about 350 millimeters and less than or equal to about 450 millimeters.

7. The ventilation hood of claim 5, wherein the side-wall is configured to return to an initial position in response to a power of the ventilation hood being turned off.

8. The ventilation hood of claim 1, wherein the main frame module comprises a lamp unit disposed at a front the through-hole and another lamp unit disposed at a rear of the through-hole.

9. The ventilation hood of claim 1, wherein the main frame module further comprises an opening defined in the third surface and through which the main frame module fluidly communicates with the expansion module, and the opening is at a location along the bracket of the main frame module which is different from a location of the first assembly structure of the main frame module.

10. The ventilation hood of claim 1, wherein
the main frame module further comprises:
a fourth surface disposed on the outer lateral portion of the first surface and disposed on an opposite side of the third surface, and
a fifth surface joining the third surface and the fourth surface,
the fourth surface comprises a bracket having a second assembly structure, and
the fifth surface comprises any one of a bracket having an assembly corresponding to the first assembly structure or the second assembly structure.

11. The ventilation hood of claim 10, wherein
the first assembly structure comprises any one of a male or a female assembly structure, and
the second assembly structure comprises one of a male or a female assembly structure different from the first assembly structure.

12. The ventilation hood of claim 11, further comprising;
the expansion module is removably attachable to the main frame module at a respective surface among the third surface and the fourth surface,
wherein
the bracket of the expansion module has the coupling surface comprising the assembly structure of the expansion module, and, and
the assembly structure of the expansion module corresponds to one of the male or the female assembly structure of the respective surface.

13. The ventilation hood of claim 12, wherein the bracket having the male or the female assembly structure is coupled in a snap-and-sliding manner.

14. The ventilation hood of claim 12, wherein
the expansion module comprises a side-wall extendable from and retractable into the ventilation hood, and
the side-wall is extendable in a direction perpendicular to and parallel to the second surface of the main frame module.

15. The ventilation hood of claim 12, wherein the expansion module comprises:
a fan configured to form a flow of air in a moving direction;
an air intake port through which air is input to the expansion module; and
a discharge duct through which air is discharged from the expansion module in the moving direction.

16. The ventilation hood of claim 12, wherein the expansion module comprises:
a lamp holder;
a lamp which is coupled to the lamp holder and emits light; and
a lamp cover which is coupled to the lamp holder, includes a transparent or translucent material and scatters light of the lamp.

17. The ventilation hood of claim 12, wherein
the expansion module comprises:
an opening defined in the coupling surface of the expansion module; and
a suction duct in fluid communication with the opening, and
the main frame module further comprises an opening defined in the respective surface and corresponding to the opening of the expansion module.

18. The ventilation hood of claim 12, wherein the expansion module comprises a holder removably attachable to the main frame module and to which different functional units can be removably attached.

19. The ventilation hood of claim 18, wherein a functional unit among the functional units comprises any one of a suction range extension unit, a lighting unit, a side-wall unit, and an air curtain unit.

20. The ventilation hood of claim 1, wherein
the axis of the motor of the motor module is disposed in a direction from the front of the appliance to the rear of the appliance, and
the controller is disposed on the first surface of the main frame module and at a front of the duct which corresponds to the front of the appliance.

* * * * *